US009579768B2

(12) United States Patent
Motoshima et al.

(10) Patent No.: US 9,579,768 B2
(45) Date of Patent: Feb. 28, 2017

(54) METHOD AND APPARATUS FOR POLISHING A SUBSTRATE

(75) Inventors: Yasuyuki Motoshima, Tokyo (JP); Toru Maruyama, Tokyo (JP); Hisanori Matsuo, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 774 days.

(21) Appl. No.: 13/548,361

(22) Filed: Jul. 13, 2012

(65) Prior Publication Data

US 2013/0023186 A1 Jan. 24, 2013

(30) Foreign Application Priority Data

Jul. 19, 2011 (JP) ..... 2011-158080
Nov. 9, 2011 (JP) ..... 2011-245482

(51) Int. Cl.

| | |
|---|---|
| ***B24B 49/14*** | (2006.01) |
| ***B24B 37/015*** | (2012.01) |
| ***B24B 55/02*** | (2006.01) |
| ***B24B 37/34*** | (2012.01) |
| ***B24B 53/017*** | (2012.01) |

(52) U.S. Cl.

CPC ..... *B24B 37/015* (2013.01); *B24B 37/34* (2013.01); *B24B 49/14* (2013.01); *B24B 53/017* (2013.01); *B24B 55/02* (2013.01)

(58) Field of Classification Search

CPC ..... B24B 53/095; B24B 49/14; B24B 53/017
USPC ..... 451/53, 41, 56
See application file for complete search history.

(56) References Cited

U.S. PATENT DOCUMENTS

| | | | | |
|---|---|---|---|---|
| 6,012,967 | A | 1/2000 | Satake et al. | |
| 6,139,406 | A * | 10/2000 | Kennedy et al. | 451/67 |
| 2004/0162007 | A1 * | 8/2004 | Phan | B24B 53/017 451/36 |
| 2007/0135020 | A1 | 6/2007 | Nabeya | |
| 2010/0279435 | A1 | 11/2010 | Xu et al. | |

FOREIGN PATENT DOCUMENTS

| | | |
|---|---|---|
| JP | 63-35390 | 7/1988 |
| JP | 05-166780 | 7/1993 |
| JP | 07-068228 | 3/1995 |
| JP | 11-188612 | 7/1999 |
| JP | 2993497 | 12/1999 |

(Continued)

*Primary Examiner* — Lee D Wilson
(74) *Attorney, Agent, or Firm* — Wenderoth, Lind & Ponack, L.L.P.

(57) ABSTRACT

A polishing apparatus polishes a surface of a substrate by pressing the substrate against a polishing pad on a polishing table. The polishing apparatus is configured to control a temperature of the polishing surface of the polishing pad by blowing a gas on the polishing pad during polishing. The polishing apparatus includes a pad temperature control mechanism having at least one gas ejection nozzle for ejecting a gas toward the polishing pad and configured to blow the gas onto the polishing pad to control a temperature of the polishing pad, and an atomizer having at least one nozzle for ejecting a liquid or a mixed fluid of a gas and a liquid and configured to blow the liquid or the mixed fluid onto the polishing pad to remove foreign matters on the polishing pad. The pad temperature control mechanism and the atomizer are formed into an integral unit.

43 Claims, 35 Drawing Sheets

(56) References Cited

FOREIGN PATENT DOCUMENTS

| | | |
|---|---|---|
| JP | 2000-280165 | 10/2000 |
| JP | 2002-118084 | 4/2002 |
| JP | 2002-211090 | 7/2002 |
| JP | 2003-068681 | 3/2003 |
| JP | 2003-133277 | 5/2003 |
| JP | 2003-142436 | 5/2003 |
| JP | 2006-093180 | 4/2006 |
| JP | 2007-059938 | 3/2007 |
| JP | 2007-181910 | 7/2007 |
| JP | 2008-066755 | 3/2008 |
| JP | 2008-528300 | 7/2008 |
| JP | 2008-307630 | 12/2008 |
| JP | 2011-136406 | 7/2011 |
| JP | 2013-022664 | 2/2013 |
| KR | 10-1999-0007262 | 1/1999 |
| KR | 10-2007-0077237 | 7/2007 |
| TW | 200531793 | 10/2005 |
| TW | 200807543 | 2/2008 |
| TW | 200845176 | 11/2008 |
| WO | 99/33612 | 7/1999 |
| WO | 2006/077994 | 7/2006 |

* cited by examiner

*FIG. 8*

| ITEM | Step1 | Step2 | Step3 | ····· | Step10 |
|---|---|---|---|---|---|
| PROCESS TIME | 5 | 100 | 30 | | 30 |
| ROTATIONAL SPEED | 10 | 20 | 30 | | |
| · | | | | | |
| · | | | | | |
| · | | | | | |
| · | | | | | |
| POLISHING PAD TEMPERATURE CONTROL | Invalid | Valid | Valid | | Invalid |
| TEMPERATURE SETTING VALUE (°C) | | 45 | 40 | | |
| MANIFOLD OSCILLATION | Invalid | Invalid | Valid | | Invalid |

METHOD AND APPARATUS FOR POLISHING A SUBSTRATE

CROSS REFERENCE TO RELATED APPLICATIONS

This document claims priorities to Japanese Application Number 2011-158080, filed Jul. 19, 2011 and Japanese Application Number 2011-245482, filed Nov. 9, 2011, the entire contents of which are hereby incorporated by reference.

BACKGROUND OF THE INVENTION

Field of the Invention

The present invention relates to a polishing apparatus and method for polishing a surface of a substrate such as a semiconductor wafer by relative movement between the surface of the substrate to be polished and a polishing pad on a polishing table while the substrate is pressed against the polishing pad, and more particularly to a polishing apparatus and method which can control a temperature of the surface (polishing surface) of the polishing pad by blowing a gas on the polishing pad.

Description of the Related Art

In recent years, high integration and high density in semiconductor device demands smaller and smaller wiring patterns or interconnections and also more and more interconnection layers. Multilayer interconnections in smaller circuits result in greater steps which reflect surface irregularities on lower interconnection layers. An increase in the number of interconnection layers makes film coating performance (step coverage) poor over stepped configurations of thin films. Therefore, better multilayer interconnections need to have the improved step coverage and proper surface planarization. Further, since the depth of focus of a photolithographic optical system is smaller with miniaturization of a photolithographic process, a surface of the semiconductor device needs to be planarized such that irregular steps on the surface of the semiconductor device will fall within the depth of focus.

Thus, in a manufacturing process of a semiconductor device, it increasingly becomes important to planarize a surface of the semiconductor device. One of the most important planarizing technologies is chemical mechanical polishing (CMP). Thus, there has been employed a chemical mechanical polishing apparatus for planarizing a surface of a semiconductor wafer. In the chemical mechanical polishing apparatus, while a polishing liquid containing abrasive particles such as silica ($SiO_2$) or ceria ($CeO_2$) therein is supplied onto a polishing pad, a substrate such as a semiconductor wafer is brought into sliding contact with the polishing pad, so that the substrate is polished.

A polishing apparatus for performing the above CMP process includes a polishing table having a polishing pad, and a substrate holding device, which is referred to as a top ring or a polishing head, for holding a substrate such as a semiconductor wafer. When the semiconductor wafer (substrate) is polished by using such a polishing apparatus, the semiconductor wafer is held and pressed against the surface (polishing surface) of the polishing pad under a predetermined pressure by the substrate holding device while a polishing liquid (slurry) is supplied from a polishing liquid supply nozzle onto the polishing pad. At this time, the polishing table and the substrate holding device are rotated to bring the semiconductor wafer into sliding contact with the polishing surface, so that the surface of the semiconductor wafer is polished to a flat mirror finish.

SUMMARY OF THE INVENTION

In the above CMP process, it is known that the step height characteristics such as dishing or erosion is severely dependent on a temperature of the polishing pad.

Further, it is confirmed that the polishing rate is also dependent on the temperature of the polishing pad, and there is a temperature range which brings about optimum polishing rate depending on the CMP process. Thus, in order to obtain the optimum polishing rate for a long time during polishing, it is necessary to maintain the optimum temperature of the polishing pad.

Therefore, the present inventors will propose a polishing apparatus in which a surface (polishing surface) of a polishing pad is cooled by ejecting a gas from gas ejection nozzles toward the polishing pad.

As described above, the polishing apparatus polishes the substrate by rotating the polishing table while the polishing liquid (slurry) is supplied from the polishing liquid supply nozzle onto the polishing pad. Therefore, there is a problem that mist of slurry supplied onto the polishing pad is scattered around. Further, after polishing of the substrate, wafer polishing of the substrate or cleaning of the substrate is performed by rotating the polishing table while pure water (deionized water) is supplied from the polishing liquid supply nozzle onto the polishing pad. Therefore, there is a problem that mist of pure water or the like supplied onto the polishing pad is scattered around. In this manner, the interior of the polishing apparatus is such an environment as to cause mist of slurry, pure water or the like, or water droplets to be scattered, and thus the scattered mist of slurry or the like is attached to surfaces of parts in the polishing apparatus and is then dried into powder. Such powder falls on the surface of the polishing pad during polishing to cause scratches on the surface of the substrate.

As in the proposed polishing apparatus, if gas ejection nozzles for blowing a gas on the polishing pad are attached to a gas supply unit (manifold) disposed above the polishing pad to control a surface (polishing surface) of the polishing pad, many parts including nozzles, nozzle attachment parts and the like are arranged so as to face the polishing pad. Therefore, slurry is attached to these many parts, and thus there is a possibility that the frequency leading to generation of powder and generation of scratches on the surface of the substrate is increased.

The present invention has been made in view of the above circumstances. It is therefore an object of the present invention to provide a polishing apparatus and method which can prevent dishing, erosion or the like from occurring to improve the step height characteristics and the polishing rate by blowing a gas from a nozzle or nozzles on a polishing pad during polishing of a substrate such as a semiconductor wafer to control a surface (polishing surface) of a polishing pad and can prevent a polishing liquid (slurry) on the polishing pad from being scattered to reduce an amount of the polishing liquid (slurry) to be attached to the nozzle or nozzles or nozzle attachment parts.

In order to achieve the above objects, according to a first aspect of the present invention, there is provided a polishing apparatus for polishing a surface of a substrate as an object to be polished by pressing the substrate against a polishing pad on a polishing table, the polishing apparatus comprising; a pad temperature control mechanism having at least one gas ejection nozzle for ejecting a gas toward the polishing pad and configured to blow the gas onto the polishing pad to control a temperature of the polishing pad; and an atomizer having at least one nozzle for ejecting a liquid or a mixed fluid of a gas and a liquid and configured to blow the liquid or the mixed fluid onto the polishing pad to remove foreign matters on the polishing pad; wherein the pad temperature control mechanism and the atomizer are formed into an integral unit.

According to the polishing apparatus of the present invention, during polishing of a substrate such as a semiconductor wafer, the gas is ejected toward the polishing pad from at least one gas ejection nozzle, and hence the surface (polishing surface) of the polishing pad can be cooled. Therefore, the surface of the polishing pad can be controlled at the optimum temperature in accordance with the CMP process, and thus the polishing rate can be improved and the step height characteristics can be improved by preventing dishing or erosion from occurring.

Further, according to the present invention, because the pad temperature control mechanism for controlling the temperature of the polishing pad by blowing the gas onto the polishing pad and the atomizer for removing foreign matters on the polishing pad by blowing the liquid or the mixed fluid onto the polishing pad are constructed as an integral unit, the number of parts can be reduced and the surface area of the unit can be remarkably reduced, thus reducing attachment of dirt. The pad temperature control mechanism and the atomizer can be used individually or can be used concurrently.

In a preferred aspect of the present invention, the pad temperature control mechanism comprises a fluid supply passage for supplying the gas to the at least one gas ejection nozzle.

In a preferred aspect of the present invention, the atomizer comprises a fluid supply passage for supplying the liquid or the mixed fluid to the at least one nozzle.

In a preferred aspect of the present invention, a gas ejection direction of the at least one gas ejection nozzle is not perpendicular to the surface of the polishing pad, but is inclined toward a rotational direction side of the polishing pad.

According to the present invention, by inclining the gas ejection direction of at least one gas ejection nozzle toward the rotational direction side of the polishing pad, the polishing pad can be cooled by high cooling capacity. This is because the inclination of the gas ejection nozzle can ensure the larger area, where the gas is blown, than that in the perpendicular nozzle. Further, in the case where the gas is blown vertically on the polishing pad, there is fear that the slurry is scattered around by splashing. However, the inclination of the nozzle allows slurry-scattering to be suppressed. Further, by inclining the gas ejection direction of the gas ejection nozzle toward the rotational direction side of the polishing pad, the effects on the flow of slurry by ejection of the gas can be reduced.

According to the present invention, the angle between the gas ejection direction of the gas ejection nozzle and the surface of the polishing pad is set, for example, in the range of 30 to 50 degrees, and thus the polishing pad can be cooled by high cooling capacity. This is because the above angle range is such an angle range as to ensure the area where the gas is blown and to allow the sufficient amount of gas to be blown effectively on the polishing pad. If the angle is smaller than 30 degrees, the area where the gas is blown becomes large, but the amount of air is lowered to reduce the cooling effect.

In a preferred aspect of the present invention, a concentric circle which passes through a point located immediately below the at least one gas ejection nozzle and is centered around a rotation center of the polishing pad is assumed and a tangential direction in the point on the concentric circle is defined as a tangential direction of rotation of the polishing pad, and a gas ejection direction of the at least one gas ejection nozzle is inclined toward a rotation center side of the polishing pad with respect to the tangential direction of rotation of the polishing pad.

According to the present invention, by inclining the gas ejection direction of at least one gas ejection nozzle toward the rotation center side of the polishing pad with respect to the tangential direction of rotation of the polishing pad, the polishing pad can be cooled by high cooling capacity. This is because the substrate polishing area on the polishing pad is a doughnut-shaped area (ring-shaped area), and by inclining the nozzle toward the rotation center side of the polishing pad with respect to the tangential direction of rotation of the polishing pad so that the gas can be ejected along the doughnut-shaped area, the substrate polishing area can be cooled efficiently.

According to the present invention, the angle of the gas ejection direction of the gas ejection nozzle with respect to the tangential direction of rotation of the polishing pad is set, for example, in the range of 15 to 35 degrees, and thus the polishing pad can be cooled by high cooling capacity. This is because the above angle range is such an angle range as to ensure the area where the gas is blown in the substrate polishing area and the angle of 35 degrees or more causes disturbance of the slurry dropping position.

In a preferred aspect of the present invention, an ejection direction of the liquid or the mixed fluid in the nozzle of the atomizer is substantially perpendicular to the surface of the polishing pad.

According to the present invention, the ejection direction of the liquid or the mixed fluid in the nozzle of the atomizer is substantially perpendicular to the surface of the polishing pad, and thus the impulse force when the liquid or the mixed fluid collides against the surface of the polishing pad can be enhanced to exert high detergency.

In a preferred aspect of the present invention, the pad temperature control mechanism and the atomizer are provided on a beam-like member which is disposed above the polishing pad and extends along substantially radial direction of the polishing pad from an outer circumferential portion to a central portion of the polishing pad.

According to the present invention, both of the pad temperature control mechanism and the atomizer are provided on the beam-like member, and thus the surface area of the entire unit can be reduced and the amount of dirt to be attached to the unit can be reduced. The beam-like member which is an elongated member is divided into right and left, and the fluid supply passage and the gas ejection nozzle for the pad temperature control mechanism are provided on one side, and the fluid passage and the nozzle for the atomizer are provided on the other side. Therefore, the pad temperature control mechanism and the atomizer can be constructed as an integral unit to become an extremely simple structure and to reduce the surface area of the entire unit.

The beam-like member is supported by the fixing arm at the outer circumferential side of the polishing table, and the fixing arm extends to the outside of the polishing table and is fixed to the apparatus frame or the like. Therefore, the beam-like member can be constructed as a cantilever and can extend above the polishing pad from the outer circumferential portion to the central portion of the polishing pad.

In a preferred aspect of the present invention, a gas ejection nozzle cover is provided at a gas ejection direction side of the gas ejection nozzle on the beam-like member.

According to the present invention, the gas ejection nozzle cover is provided so as to cover the upper side of the gas ejection nozzle, and hence the gas ejected from the gas ejection nozzle can be flowed toward the polishing pad without being diffused and the polishing pad can be cooled efficiently.

In a preferred aspect of the present invention, the gas ejection nozzle cover is inclined with respect to the surface of the polishing pad such that the gas ejection nozzle cover becomes closer to the surface of the polishing pad as the gas ejection nozzle cover becomes more distant from the beam-like member.

According to the present invention, the gas ejection nozzle cover is provided in a downwardly inclined state so as to be closer to the polishing pad in conformity with the gas ejection direction of the gas ejection nozzle, and hence the gas ejected from the gas ejection nozzle can be flowed toward the polishing pad without being diffused and the polishing pad can be cooled efficiently.

In a preferred aspect of the present invention, at least one gas direction adjustment plate for controlling a flow direction of the gas ejected from the gas ejection nozzle is provided inside the gas ejection nozzle cover, and the gas direction adjustment plate comprises a plate-like member extending from the gas ejection nozzle cover toward the polishing pad.

According to the present invention, the flow direction of the gas ejected from the gas ejection nozzle can be controlled by the gas direction adjustment plate, and thus the gas can be flowed along the polishing pad and the polishing pad can be cooled efficiently.

In a preferred aspect of the present invention, a concentric circle which passes through a point located immediately below the at least one gas direction adjustment plate and is centered around a rotation center of the polishing pad is assumed and a tangential direction in the point on the concentric circle is defined as a tangential direction of rotation of the polishing pad, and the at least one gas direction adjustment plate is inclined toward a rotation center side of the polishing pad with respect to the tangential direction of rotation of the polishing pad.

According to the present invention, the gas ejected from the gas ejection nozzle can be flowed toward the central side of the polishing table.

According to the present invention, the angle of the flat plate-like gas direction adjustment plate is set, for example, in the range of 15 to 45 degrees, and thus the polishing pad can be cooled by high cooling capacity. This is because the above angle range is such an angle range as to ensure the area where the gas is blown and the polishing pad can be cooled efficiently. If the angle is larger than 45 degrees, the amount of the gas which collides against the gas direction adjustment plate increases and the gas is depressurized and decelerated to reduce the cooling capacity, and the gas which collides against the gas direction adjustment plate and is then reflected causes disturbance of the slurry film thickness and the slurry dropping position on the polishing pad.

In a preferred aspect of the present invention, the polishing apparatus further comprises a mechanism for adjusting a direction of the gas ejection nozzle cover and/or a mechanism for adjusting a direction of the gas direction adjustment plate.

According to the present invention, the inclination of the gas ejection nozzle cover can be adjusted at the optimum angle in accordance with the gas approach angle between the surface (polishing surface) of the polishing pad and the gas ejection direction of the gas ejection nozzle.

According to the present invention, the directions of the plural gas direction adjustment plates can be adjusted in conjunction with one another or can be adjusted individually by the mechanism for adjusting the direction of the gas direction adjustment plate.

In a preferred aspect of the present invention, a scattering-prevention cover for the atomizer is provided at an opposite side of the gas ejection nozzle cover on the beam-like member.

According to the present invention, when the polishing pad is cleaned by the atomizer, the fluid ejected from the atomizer or the foreign matters on the polishing pad can be prevented from being scattered around.

In a preferred aspect of the present invention, the polishing apparatus further comprises: a control valve configured to control a flow rate of the gas ejected from the at least one gas ejection nozzle; a thermometer configured to detect a temperature of the polishing pad; and a controller configured to control the flow rate of the gas ejected from the at least one gas ejection nozzle by comparing a preset temperature as a control target temperature of the polishing pad and the temperature of the polishing pad detected by the thermometer and by adjusting a ratio of valve opening of the control valve.

According to the present invention, the flow rate of the gas ejected from at least one gas ejection nozzle is controlled by the control valve and the temperature of the polishing pad is detected by the thermometer, and the preset temperature as a control target temperature of the polishing pad and the temperature of the polishing pad detected by the thermometer are compared and the ratio of valve opening of the control valve is adjusted. Thus, the flow rate of the gas ejected from at least one gas ejection nozzle can be controlled. Accordingly, the surface of the polishing pad can be controlled at the optimum temperature according to the CMP process.

According to a second aspect of the present invention, there is provided a polishing method of polishing a surface of a substrate as an object to be polished by pressing the substrate against a polishing pad on a polishing table while a polishing liquid is supplied onto the polishing pad, the polishing method comprising: ejecting a gas toward the polishing pad from at least one gas ejection nozzle; and blowing the gas onto the polishing pad by adjusting a direction of the gas ejected from the at least one gas ejection nozzle with a gas direction adjustment plate provided near the gas ejection nozzle.

According to the present invention, the gas ejected from the gas ejection nozzle can be flowed along the polishing pad by the gas direction adjustment plate, and thus the polishing pad can be cooled efficiently. Further, the flow of the polishing liquid on the polishing pad can be controlled by controlling the flow direction of the gas with the gas direction adjustment plate.

In some cases, the polishing rate or the planarization of the polished surface is changed depending on conditions of the polishing liquid (amount, concentration, product material and the like), and thus the flow of the polishing liquid on the polishing pad is controlled by controlling the flow of the gas ejected from the gas ejection nozzle with the gas direction adjustment plate. Therefore, the polishing performance can be controlled.

In a preferred aspect of the present invention, a flow of the polishing liquid on the polishing pad is controlled by adjusting the direction of the gas ejected from the gas ejection nozzle with the gas direction adjustment plate.

According to the present invention, by adjusting the direction of the gas ejected from the gas ejection nozzle with the gas direction adjustment plate, the turbulance of the polishing liquid on the polishing pad can be reduced, and the film thickness of the polishing liquid can be substantially uniformized during polishing. Therefore, the entire surface of the substrate can be uniformly polished. Further, by adjusting the direction of the gas ejected from the gas ejection nozzle with the gas direction adjustment plate, the polishing liquid is allowed to flow more (or less) to the edge or the central area of the substrate, and hence the polishing rate and the in-plane uniformity can be controlled.

In a preferred aspect of the present invention, the gas ejection nozzle and the gas direction adjustment plate are disposed at a downstream side of a dresser in a rotational direction of the polishing table; and a flow of the polishing liquid on the polishing pad is controlled at the downstream side of the dresser which conducts dressing during polishing.

According to the present invention, if a dressing process by the dresser is conducted during polishing, the flow of the polishing liquid is interrupted, and thus the film thickness of the polishing liquid tends to become in a disturbed state. However, by adjusting the direction of the gas ejected from the gas ejection nozzle with the gas direction adjustment plate, the flow of the polishing liquid can be controlled at the downstream side of the dresser, and thus the film thickness of the polishing liquid can be controlled. Therefore, the film thickness of the polishing liquid which has been disturbed in the dressing process can be gentle, i.e., can be substantially uniformized. Thus, the entire surface of the substrate can be polished uniformly.

In a preferred aspect of the present invention, the polishing liquid which flows toward an outer circumferential side of the polishing pad is controlled so as to flow toward a central side of the polishing pad by adjusting a direction of the gas ejected from the gas ejection nozzle with the gas direction adjustment plate.

According to the present invention, the fresh slurry supplied from the polishing liquid supply nozzle to the polishing pad can be prevented from flowing down from the polishing pad without being used for polishing, and can remain on the polishing pad. Therefore, the polishing performance can be improved and the consumed amount of the polishing liquid can be reduced.

In a preferred aspect of the present invention, old polishing liquid which has been used for polishing and is located at a downstream side of a top ring for holding the substrate in a rotational direction of the polishing table is controlled so as to flow toward an outer circumferential side of the polishing pad by adjusting a direction of the gas ejected from the gas ejection nozzle with the gas direction adjustment plate.

According to the present invention, the old polishing liquid which has been used for polishing and is located at a downstream side of the top ring for holding the substrate in the rotational direction of the polishing table can be discharged as quickly as possible. Therefore, the present invention can prevent such a situation that the old polishing liquid remains on the polishing surface and the polishing rate and the in-plane uniformity are adversely affected.

In a preferred aspect of the present invention, a polishing liquid supply nozzle for supplying the polishing liquid onto the polishing pad is swingable, and a supply position of the polishing liquid is changed during polishing.

According to the present invention, by changing the supply position of the polishing liquid during polishing, the required amount of the polishing liquid can be supplied to the most effective position for polishing on the polishing pad.

According to a third aspect of the present invention, there is provided a polishing method of polishing a surface of a substrate as an object to be polished by pressing the substrate against a polishing pad on a polishing table while controlling a temperature of the polishing pad by ejecting a gas toward the polishing pad, the polishing method comprising: starting temperature control of the polishing pad after setting a preset temperature as a control target temperature of the polishing pad and monitoring the temperature of the polishing pad; and determining that polishing abnormality occurs in the case where the time when the temperature of the polishing pad becomes outside the range of the preset temperature exceeds a predetermined time continuously after the temperature of the polishing pad reaches the range of the preset temperature.

According to the present invention, after setting the preset temperature as a control target temperature of the polishing pad, the gas is ejected toward the polishing pad to start temperature control of the polishing pad and to monitor the temperature of the polishing pad. Then, in the case where the time when the temperature of the polishing pad becomes outside the range of the preset temperature exceeds a predetermined time continuously after the temperature of the polishing pad reaches the range of the preset temperature, it is judged that polishing abnormality in which the temperature control of the polishing pad is not performed normally occurs.

In a preferred aspect of the present invention, the becoming outside the range of the preset temperature comprises becoming outside the range of an upper limit or a lower limit of the preset temperature.

In a preferred aspect of the present invention, the preset temperature of the polishing pad is changed during polishing, and the required time from change of the preset time to reaching the changed preset temperature is measured, and then the required time and the preset time are compared and when the required time is longer than the preset time, it is judged that polishing abnormality occurs.

According to the present invention, after setting the preset temperature as a control target temperature of the polishing pad, the gas is ejected toward the polishing pad to start temperature control of the polishing pad and to monitor the temperature of the polishing pad. Then, the preset temperature of the polishing pad is changed during polishing, and the required time from change of the preset time to reaching the changed preset temperature is measured, and then the required time and the preset time are compared. If the required time is longer than the preset time, it is judged that polishing abnormality in which the temperature control of the polishing pad is not performed normally occurs.

According to a fourth aspect of the present invention, there is provided a polishing method of polishing a surface of a substrate as an object to be polished by pressing the substrate against a polishing pad on a polishing table while controlling a temperature of the polishing pad by ejecting a gas toward the polishing pad, the polishing method comprising: starting temperature control of the polishing pad and monitoring the temperature of the polishing pad; and determining that polishing abnormality occurs in the case where the temperature of the polishing pad does not reach a target temperature after an elapse of a predetermined time from starting the temperature control.

According to the present invention, after setting the preset temperature as a control target temperature of the polishing pad, the gas is ejected toward the polishing pad to start temperature control of the polishing pad and to monitor the temperature of the polishing pad. Then, in the case where the temperature of the polishing pad does not reach the target temperature after an elapse of a predetermined time from starting the temperature control, it is judged that polishing abnormality in which the temperature control of the polishing pad is not performed normally occurs.

According to a fifth aspect of the present invention, there is provided a polishing method of polishing a surface of a substrate as an object to be polished by pressing the substrate against a polishing pad on a polishing table while controlling a temperature of the polishing pad by ejecting a gas toward the polishing pad, the polishing method comprising: starting temperature control of the polishing pad after setting a preset temperature as a control target temperature of the polishing pad and monitoring the temperature of the polishing pad; changing the preset temperature of the polishing pad during polishing; and determining that polishing abnormality occurs in the case where the temperature of the polishing pad does not reach the changed preset temperature after an elapse of a predetermined time from changing the preset temperature.

According to the present invention, after setting the preset temperature as a control target temperature of the polishing pad, the gas is ejected toward the polishing pad to start temperature control of the polishing pad and to monitor the temperature of the polishing pad. Then, the preset temperature of the polishing pad is changed during polishing, and in the case where the temperature of the polishing pad does not reach the changed preset temperature after an elapse of a predetermined time from changing the preset temperature, it is judged that polishing abnormality in which the temperature control of the polishing pad is not performed normally occurs.

According to a sixth aspect of the present invention, there is provided a polishing apparatus for polishing a surface of a substrate as an object to be polished by pressing the substrate against a polishing pad on a polishing table, the polishing apparatus comprising; at least one gas ejection nozzle configured to eject a gas toward the polishing pad; and a gas supply unit configured to hold the at least one gas ejection nozzle and supply the gas to the at least one gas ejection nozzle; wherein a concentric circle which passes through a point located immediately below the at least one gas ejection nozzle and is centered around a ration center of the polishing pad is assumed and a tangential direction in the point on the concentric circle is defined as a tangential direction of rotation of the polishing pad, and a gas ejection direction of the at least one gas ejection nozzle is inclined toward a rotation center side of the polishing pad with respect to the tangential direction of rotation of the polishing pad.

According to the present invention, the gas is supplied from the gas supply unit to at least one gas ejection nozzle during polishing of the substrate such as a semiconductor wafer, and the gas is ejected toward the polishing pad from at least one gas ejection nozzle to cool the surface (polishing surface) of the polishing pad. Therefore, the surface of the polishing pad can be controlled at the optimum temperature in accordance with the CMP process, and thus the polishing rate can be improved and the step height characteristics can be improved by preventing dishing or erosion from occurring.

In the present invention, the concentric circle which passes through a point located immediately below at least one gas ejection nozzle and is centered around the rotation center of the polishing pad is assumed and the tangential direction in the point on the concentric circle is defined as a tangential direction of rotation of the polishing pad, and the gas ejection direction of at least one gas ejection nozzle is inclined toward the rotation center side of the polishing pad with respect to the tangential direction of rotation of the polishing pad. In this manner, by inclining the gas ejection direction of at least one gas ejection nozzle toward the rotation center side of the polishing pad with respect to the tangential direction of rotation of the polishing pad, the polishing pad can be cooled by high cooling capacity. This is because the substrate polishing area on the polishing pad is a doughnut-shaped area (ring-shaped area), and by inclining the nozzle toward the rotation center side of the polishing pad with respect to the tangential direction of rotation of the polishing pad so that the gas can be ejected along the doughnut-shaped area, the substrate polishing area can be cooled efficiently.

According to a seventh aspect of the present invention, there is provided a polishing apparatus for polishing a surface of a substrate as an object to be polished by pressing the substrate against a polishing pad on a polishing table, the polishing apparatus comprising; at least one gas ejection nozzle configured to eject a gas toward the polishing pad; and a gas supply unit configured to hold the at least one gas ejection nozzle and supply the gas to the at least one gas ejection nozzle; wherein a gas ejection direction of the at least one gas ejection nozzle is not perpendicular to the surface of the polishing pad, but is inclined toward a rotational direction side of the polishing pad.

According to the present invention, the gas is supplied from the gas supply unit to at least one gas ejection nozzle during polishing of the substrate such as a semiconductor wafer, and the gas is ejected toward the polishing pad from at least one gas ejection nozzle to cool the surface (polishing surface) of the polishing pad. Therefore, the surface of the polishing pad can be controlled at the optimum temperature in accordance with the CMP process, and thus the polishing rate can be improved and the step height characteristics can be improved by preventing dishing or erosion from occurring.

In the present invention, the gas ejection direction of at least one gas ejection nozzle is not perpendicular to the surface of the polishing pad, but is inclined toward the rotational direction side of the polishing pad. In this manner, by inclining the gas ejection direction of at least one gas ejection nozzle toward the rotational direction side of the polishing pad, the polishing pad can be cooled by high cooling capacity. This is because the inclination of the gas ejection nozzle can ensure the larger area, where the gas is blown, than that in the perpendicular nozzle. Further, in the case where the gas is blown vertically on the polishing pad, there is fear that the slurry is scattered around by splashing. However, the inclination of the nozzle allows slurry-scattering to be suppressed. Further, by inclining the gas ejection direction of the gas ejection nozzle toward the rotational direction side of the polishing pad, the effects on the flow of slurry by ejection of the gas can be reduced.

In a preferred aspect of the present invention, a height of the at least one gas ejection nozzle from the surface of the polishing pad is adjustable.

According to the present invention, by adjusting the height of the gas ejection nozzle from the surface of the polishing pad, the gas ejection nozzle can be positioned at the optimum height position. Therefore, the polishing pad can be cooled by high cooling capacity.

In a preferred aspect of the present invention, an angle of the gas ejection direction of the at least one gas ejection nozzle with respect to the tangential direction of rotation of the polishing pad is set in the range of 15 to 35 degrees.

According to the present invention, the angle of the gas ejection direction of the gas ejection nozzle with respect to the tangential direction of rotation of the polishing pad is set, for example, in the range of 15 to 35 degrees, and thus the polishing pad can be cooled by high cooling capacity. This is because the above angle range is such an angle range as to ensure the area where the gas is blown in the substrate polishing area and the angle of 35 degrees or more causes disturbance of the slurry dropping position.

In a preferred aspect of the present invention, an angle of the gas ejection direction of the at least one gas ejection nozzle with respect to the surface of the polishing pad is set in the range of 30 to 50 degrees.

According to the present invention, the angle between the gas ejection direction of the gas ejection nozzle and the surface of the polishing pad is set in the range of 30 to 50 degrees, and thus the polishing pad can be cooled by high cooling capacity. This is because the above angle range is such an angle range as to ensure the area where the gas is blown and to allow the sufficient amount of gas to be blown effectively on the polishing pad. If the angle is smaller than 30 degrees, the area where the gas is blown becomes large, but the amount of gas to be blown is lowered to reduce the cooling effect.

In a preferred aspect of the present invention, the polishing apparatus further comprises: a control valve configured to control a flow rate of the gas ejected from the at least one gas ejection nozzle; a thermometer configured to detect a temperature of the polishing pad; and a controller configured to control the flow rate of the gas ejected from the at least one gas ejection nozzle by comparing a preset temperature as a control target temperature of the polishing pad and the temperature of the polishing pad detected by the thermometer and by adjusting a ratio of valve opening of the control valve.

According to the present invention, the flow rate of the gas ejected from at least one gas ejection nozzle is controlled by the control valve and the temperature of the polishing pad is detected by the thermometer, and the flow rate of the gas ejected from at least one gas ejection nozzle can be controlled by comparing the preset temperature as a control target temperature of the polishing pad and the temperature of the polishing pad detected by the thermometer and by adjusting the ratio of valve opening of the control valve. Accordingly, the surface of the polishing pad can be controlled at the optimum temperature according to the CMP process.

In a preferred aspect of the present invention, the controller controls the flow rate of the gas ejected from at least one gas ejection nozzle by adjusting the ratio of valve opening of the control valve with a PID control on the basis of the difference between the preset temperature of the polishing pad and the detected temperature of the polishing pad.

According to the present invention, the controller selects certain PID parameters from several PID parameters on the basis of a predetermined rule, and controls the temperature of the polishing pad surface using the PID parameters selected on the basis of the pad temperature information. Therefore, the polishing rate of the substrate can be maintained optimally and constantly, and thus the polishing time can be shortened. Further, as a result, the amount of slurry to be used and the amount of waste liquid can be reduced.

According to an eighth aspect of the present invention, there is provided a polishing method of polishing a surface of a substrate as an object to be polished by pressing the substrate against a polishing pad on a polishing table, said polishing method comprising: supplying a gas from a gas supply unit to at least one gas ejection nozzle; and ejecting the gas toward the polishing pad from said at least one gas ejection nozzle; wherein a concentric circle which passes through a point located immediately below said at least one gas ejection nozzle and is centered around a rotation center of the polishing pad is assumed and a tangential direction in said point on said concentric circle is defined as a tangential direction of rotation of the polishing pad, and a gas ejection direction of said at least one gas ejection nozzle is inclined toward a rotation center side of the polishing pad with respect to said tangential direction of rotation of the polishing pad.

According to a ninth aspect of the present invention, there is provided a polishing method of polishing a surface of a substrate as an object to be polished by pressing the substrate against a polishing pad on a polishing table, the polishing method comprising: supplying a gas from a gas supply unit to at least one gas ejection nozzle; and ejecting the gas toward the polishing pad from the at least one gas ejection nozzle; wherein a gas ejection direction of the at least one gas ejection nozzle is not perpendicular to the surface of the polishing pad, but is inclined toward a rotational direction side of the polishing pad.

In a preferred aspect of the present invention, a height of the at least one gas ejection nozzle from the surface of the polishing pad is adjustable.

In a preferred aspect of the present invention, an angle of the gas ejection direction of the at least one gas ejection nozzle with respect to the tangential direction of rotation of the polishing pad is set in the range of 15 to 35 degrees.

In a preferred aspect of the present invention, an angle of the gas ejection direction of the at least one gas ejection nozzle with respect to the surface of the polishing pad is set in the range of 30 to 50 degrees.

In a preferred aspect of the present invention, a flow rate of the gas ejected from the at least one gas ejection nozzle is controlled by a control valve and a temperature of the polishing pad is detected by a thermometer; and the flow rate of the gas ejected from the at least one gas ejection nozzle is controlled by comparing a preset temperature as a control target temperature of the polishing pad and the temperature of the polishing pad detected by the thermometer and by adjusting a ratio of valve opening of the control valve.

In a preferred aspect of the present invention, the flow rate of the gas ejected from the at least one gas ejection nozzle is controlled by adjusting the ratio of valve opening of the control valve with a PID control on the basis of a difference between the preset temperature of the polishing pad and the detected temperature of the polishing pad.

In a preferred aspect of the present invention, there is provided a polishing method of polishing a surface of a substrate as an object to be polished by pressing the substrate against a polishing pad on a polishing table while controlling a temperature of the polishing pad by ejecting a gas toward the polishing pad, the polishing method comprising: starting temperature control of the polishing pad after setting a preset temperature as a control target temperature of the polishing pad and monitoring the temperature of the polishing pad; measuring a required time from start of the temperature control to reaching the preset temperature; comparing the required time and the preset time; and determining that polishing abnormality occurs in the case where the required time is longer than the preset time.

According to the present invention, after setting the preset temperature as a control target temperature of the polishing pad, the gas is ejected toward the polishing pad to start temperature control of the polishing pad and to monitor the temperature of the polishing pad. Then, the required time from start of the temperature control to reaching the preset temperature is measured, and the required time and the preset time are compared. If the required time is longer than the preset time, it is judged that polishing abnormality in which the temperature control of the polishing pad is not performed normally occurs.

The present invention has the following effects:

(1) By cooling the surface of the polishing pad during polishing, the following two effects can be expected.

A. The polishing rate can be improved to raise productivity, and the cost of consumable goods such as a polishing liquid (slurry) per one substrate can be reduced. For example, by maintaining the surface of the polishing pad at a predetermined temperature in the main polishing step, the polishing rate can be improved to raise productivity, and the cost of consumable goods such as a polishing liquid (slurry) per one substrate can be reduced.

B. The step height characteristics can be improved by preventing dishing or erosion from occurring.

(2) By optimizing the position on the polishing pad where the gas is blown, the further increased cooling effect of the polishing pad can be expected and the further reduction of the dishing and the erosion can be expected. For example, by maintaining the surface of the polishing pad at a predetermined temperature in the finish polishing step, the step height characteristics can be improved by preventing dishing or erosion from occurring.

(3) When the error of the time when the temperature of the polishing pad does not reach the preset temperature as a control target temperature for cooling the polishing pad or the error of the time when the temperature of the polishing pad exceeds the upper limit of the preset temperature or is lowered than the lower limit of the preset temperature occurs, the process interlock works, and thus polishing of the subsequent substrate is not performed. Therefore, defective product is limited to one substrate which has been polished at the time of occurrence of the error, thus contributing to improvement of production yield.

(4) Because the pad temperature control mechanism for controlling the temperature of the polishing pad by blowing the gas onto the polishing pad and the atomizer for removing foreign matters on the polishing pad by blowing the liquid or the mixed fluid are constructed as an integral unit, the following three effects can be expected.

A. The number of parts can be reduced and the surface area of the unit can be reduced, and thus attachment of dirt can be reduced.

B. The assembling of the unit becomes simple and the reproducibility of the assembling can be improved. If the position of the nozzle is changed, there is a possibility that the process is adversely affected, and thus improvement of the reproducibility of the assembling is important.

C. The attachment space of the unit becomes small, and thus the space above the polishing table can be effectively utilized.

(5) In addition to the gas ejection nozzle, the gas direction adjustment plate for controlling the flow direction of the gas is provided on the pad temperature adjustment mechanism, and thus the following three effects can be expected.

A. The turbulance of the polishing liquid on the polishing pad can be reduced during polishing, and thus the film thickness of the polishing liquid can be substantially uniformized.

B. The polishing liquid is allowed to flow more (or less) to the edge or the central area of the substrate, and hence the polishing rate and the in-plane uniformity can be controlled.

C. The old polishing liquid which has been used for polishing can be discharged as quickly as possible, and the fresh slurry can be prevented from flowing down from the polishing pad and can remain on the polishing pad. Therefore, the polishing performance can be improved and the consumed amount of the polishing liquid can be reduced.

BRIEF DESCRIPTION OF THE DRAWINGS

FIG. 8 is a table showing an example of a polishing recipe;

FIG. 20A is a perspective view, FIG. 20B is a plan view and FIG. 20C is an elevational view;

FIG. 21A is a perspective view, FIG. 21B is a plan view and FIG. 21C is an elevational view;

FIG. 20A is a plan view, FIG. 20B is an elevational view and FIG. 20C is a side view;

FIG. 23A is a schematic view showing the relationship between the directions of the gas direction adjustment plates and the slurry film thickness, and FIG. 23B is a schematic view showing the relationship between the polishing liquid (slurry) on the polishing pad and the substrate held by the top ring;

FIG. 24A is a schematic view showing a mechanism for controlling gas guide angles of a plurality of gas direction adjustment plates independently, and FIGS. 24B and 24C are schematic views showing mechanisms for controlling gas guide angles of a plurality of gas direction adjustment plates in conjunction with one another;

DETAILED DESCRIPTION OF THE PREFERRED EMBODIMENTS

Figure 1:
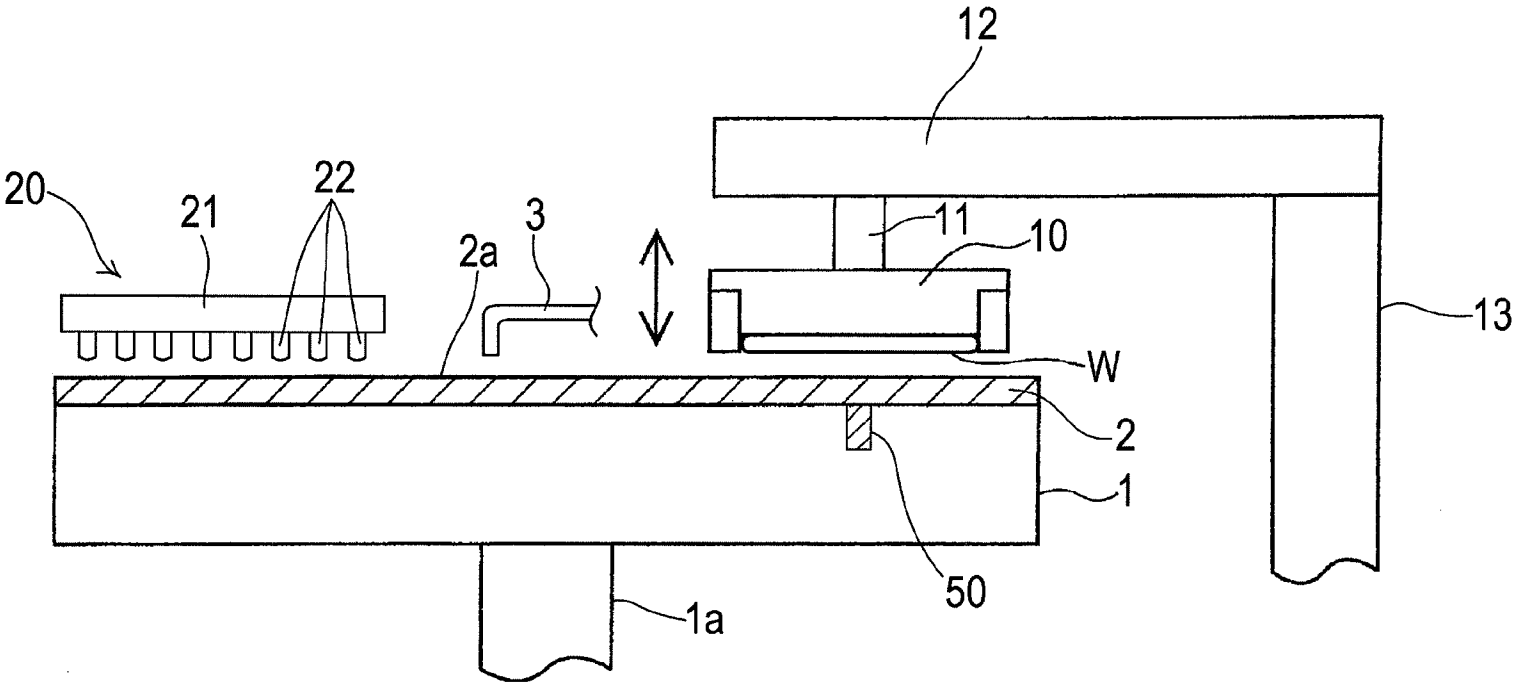
FIG. 1 is a schematic view showing an entire structure of a polishing apparatus according to a first embodiment of the present invention.

A polishing apparatus and method according to a first embodiment of the present invention will be described below with reference to FIGS. 1 through 9. Like or corresponding parts are denoted by like or corresponding reference numerals in FIGS. 1 through 9 and will not be described below repetitively.

FIG. 1 is a schematic view showing an entire structure of a polishing apparatus according to a first embodiment of the present invention. As shown in FIG. 1, the polishing apparatus comprises a polishing table 1, and a polishing head 10 for holding a substrate W such as a semiconductor wafer as an object to be polished and pressing the substrate against a polishing pad on the polishing table 1. The polishing table 1 is coupled via a table shaft 1*a* to a polishing table rotating motor (not shown) disposed below the polishing table 1. Thus, the polishing table 1 is rotatable about the table shaft 1*a*. A polishing pad 2 is attached to an upper surface of the polishing table 1. An upper surface of the polishing pad 2 constitutes a polishing surface 2*a* for polishing the substrate W. The polishing pad 2 comprising SUBA 800, IC-1000, IC-1000/SUBA400 (two-layer cloth) or the like manufactured by the Dow Chemical Company is used. The SUBA 800 is non-woven fabrics bonded by urethane resin. The IC-1000 comprises a pad composed of hard polyurethane foam and having a large number of fine holes formed in its surface, and is also called a perforated pad. A polishing liquid supply nozzle 3 is provided above the polishing table 1 to supply a polishing liquid (slurry) onto the polishing pad 2 on the polishing table 1. A film thickness measuring instrument 50 such as an eddy current sensor or an optical sensor is provided within the polishing table 1.

The polishing head 10 is connected to a shaft 11, and the shaft 11 is vertically movable with respect to a support arm 12. When the shaft 11 moves vertically, the polishing head 10 is lifted and lowered as a whole for positioning with respect to the support arm 12. The shaft 11 is configured to be rotated by operating a polishing head rotating motor (not shown). The polishing head 10 is rotated about the shaft 11 by rotation of the shaft 11.

The polishing head 10 is configured to hold the substrate W such as a semiconductor wafer on its lower surface. The support arm 12 is configured to be pivotable about a shaft 13. Thus, the polishing head 10, which holds the substrate W on its lower surface, is movable from a position at which the polishing head 10 receives the substrate to a position above the polishing table 1 by pivotable movement of the support arm 12. Then, the polishing head 10 holds the substrate W on its lower surface and presses the substrate W against the surface (polishing surface) 2*a* of the polishing pad 2. At this time, while the polishing table 1 and the polishing head 10 are respectively rotated, a polishing liquid (slurry) is supplied onto the polishing pad 2 from the polishing liquid supply nozzle 3 provided above the polishing table 1. The polishing liquid containing silica ($SiO_2$) or ceria ($CeO_2$) as abrasive particles is used. In this manner, while the polishing liquid is supplied onto the polishing pad 2, the substrate W is pressed against the polishing pad 2 and is moved relative to the polishing pad 2 to polish an insulating film, a metal film or the like on the substrate.

As shown in FIG. 1, the polishing apparatus has a pad temperature control device 20 for controlling a temperature of the surface (polishing surface) 2*a* of the polishing pad 2 by blowing a gas on the polishing pad 2. The pad temperature control device 20 comprises a cylindrical manifold 21 which is disposed above the polishing pad 2 in parallel to the surface (polishing surface) 2*a* of the polishing pad 2 and extends along substantially radial direction of the polishing pad 2, and a plurality of gas ejection nozzles 22 attached to the lower part of the cylindrical manifold 21 at predetermined intervals. The manifold 21 is connected to a compressed air source (not shown), and when compressed air is supplied into the manifold 21, the compressed air is ejected from the gas ejection nozzles 22 toward the polishing surface 2*a* of the polishing pad 2. The manifold 21 constitutes a gas supply unit for holding the gas ejection nozzles 22 and supplying a gas to the gas ejection nozzles 22.

Figure 2:
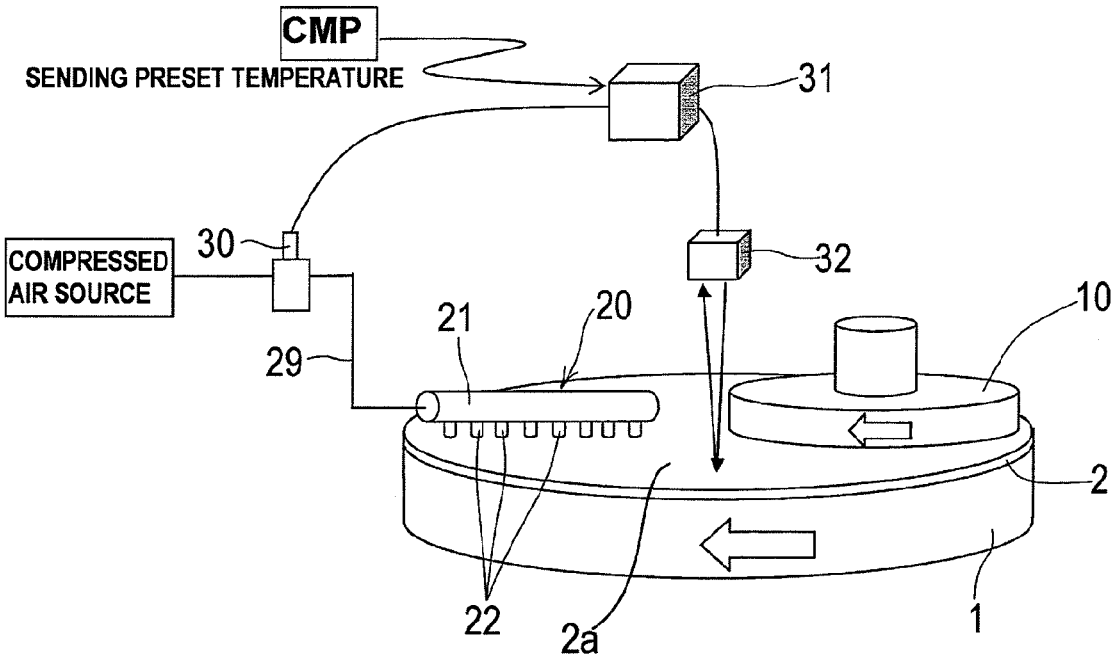
FIG. 2 is a perspective view showing control equipment of the pad temperature control device.

FIG. 2 is a perspective view showing control equipment of the pad temperature control device 20. As shown in FIG. 2, the polishing pad 2 is attached to an upper surface of the polishing table 1. The polishing head 10 is disposed above the polishing pad 2, and the polishing head 10 is configured to hold the substrate W (see FIG. 1) and to press the substrate W against the polishing pad 2. The manifold 21 of the pad temperature control device 20 is connected to a compressed air source by a compressed air supply line 29. A pressure regulating valve 30 is provided in the compressed air supply line 29, and the compressed air supplied from the compressed air source passes through the pressure regulating valve 30, thereby regulating a pressure and a flow rate of the compressed air. The pressure regulating valve 30 is connected to a temperature controller 31. The compressed air may be a normal temperature or may be cooled to a predetermined temperature.

As shown in FIG. 2, a radiation thermometer 32 for detecting a surface temperature of the polishing pad 2 is provided above the polishing pad 2. The radiation thermometer 32 is connected to the temperature controller 31. Preset temperatures which are control target temperatures of the polishing pad 2 are inputted into the temperature controller 31 from a CMP controller for controlling the entirety of the polishing apparatus. Further, the preset temperatures may be directly inputted into the temperature controller 31. The temperature controller 31 controls a ratio of valve opening of the pressure regulating valve 30 in response to the difference between the preset temperature of the polishing pad 2 inputted into the temperature controller 31 and the actual temperature of the polishing pad 2 detected by the radiation thermometer 32 by a PID control, thereby controlling a flow rate of the compressed air ejected from the gas ejection nozzles 22. With this arrangement, the compressed air is blown at the optimum flow rate onto the polishing surface 2*a* of the polishing pad 2, and hence the temperature of the polishing surface 2*a* of the polishing pad 2 can be maintained at the target temperature (preset temperature) which has been preset by the temperature controller 31.

Figure 3:
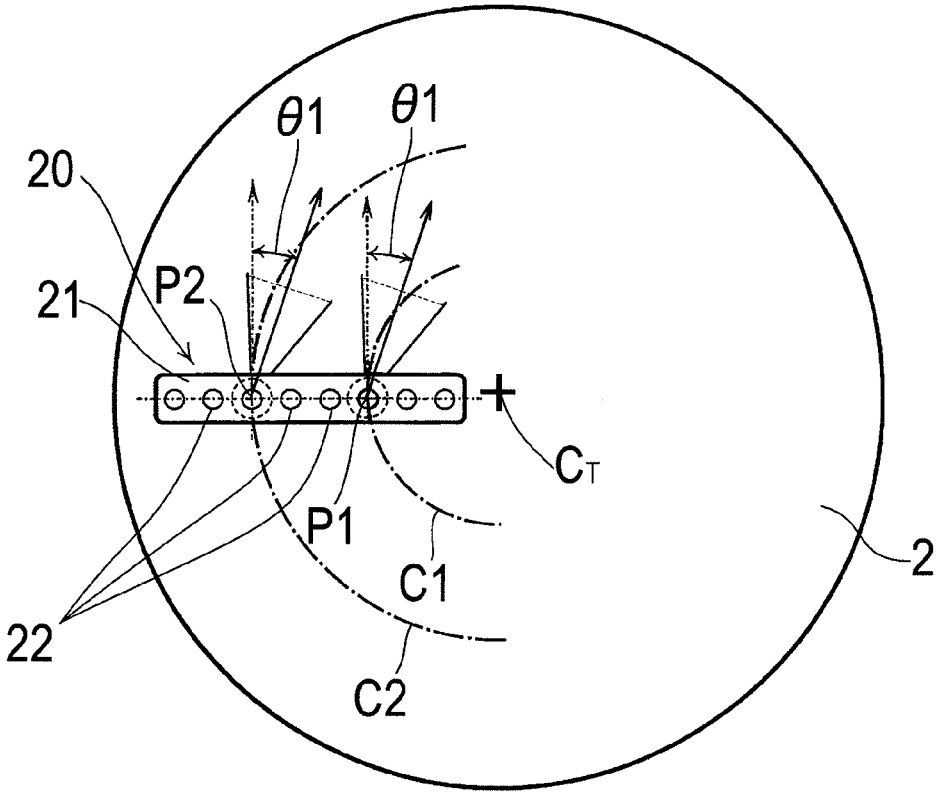
FIG. 3 is a plan view showing the relationship between the gas ejection nozzles of the pad temperature control device and the polishing pad.
Figure 4:
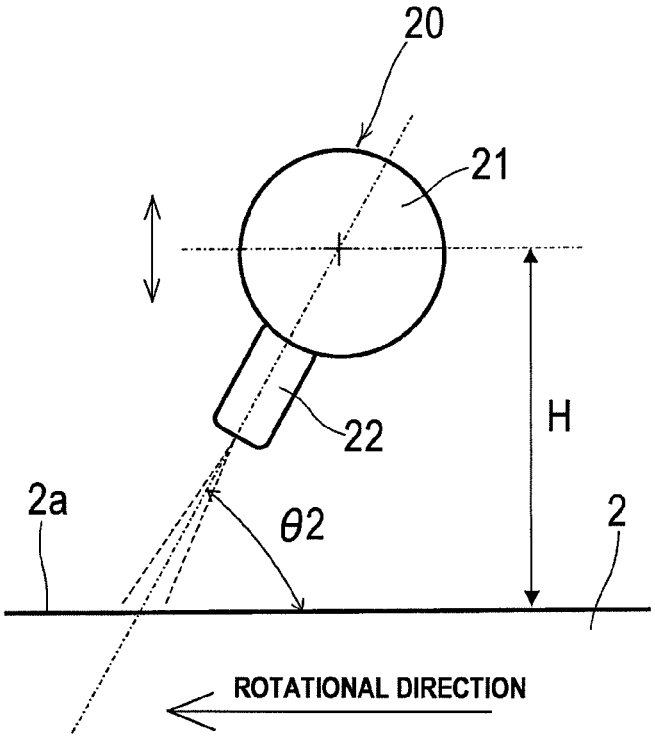
FIG. 4 is a side view showing the relationship between the gas ejection nozzles of the pad temperature control device and the polishing pad.

FIGS. 3 and 4 are views showing the relationship between the gas ejection nozzles 22 of the pad temperature control device 20 and the polishing pad 2, and FIG. 3 is a plan view and FIG. 4 is a side view. As shown in FIG. 3, a plurality of gas ejection nozzles 22 are attached at predetermined intervals to the manifold 21 of the pad temperature control device 20 (eight nozzles are attached in the illustrated example). During polishing, the polishing pad 2 rotates in a clockwise direction about a rotation center $C_T$. In FIG. 3, the nozzles are numbered in ascending sequence of 1, 2, 3, . . . 8 from the inner side of the polishing pad, and the two gas ejection nozzles 22 of the third and sixth ones as an example will be described. Specifically, in the case where concentric circles C1 and C2 which pass through points P1 and P2, respectively, located immediately below the two gas ejection nozzles 22 of the third and sixth ones and are centered around the rotation center $C_T$ are assumed, and tangential directions in the respective points P1 and P2 on the respective concentric circles C1 and C2 are defined as tangential directions of rotation of the polishing pad, gas ejection directions of the gas ejection nozzles 22 are inclined at a predetermined angle (θ1) toward the pad center side with respect to the tangential directions of rotation of the polishing pad. The gas ejection direction means a direction of a center line of an angle (gas ejection angle) which spreads out in a fan-like form from a gas ejection nozzle port. Other nozzles besides the third and sixth nozzles are inclined at the predetermined angle (θ1) toward the pad center side with respect to the tangential directions of rotation of the polishing pad in the same manner. Then, the angle (θ1) of the gas ejection direction of the gas ejection nozzle 22 with respect to the tangential direction of rotation of the polishing pad is set in the range of 15 to 35 degrees in connection with nozzle cooling capacity (described later). Although the case where a plurality of nozzles are provided has been described, a single nozzle may be provided.

Further, as shown in FIG. 4, the gas ejection direction of the gas ejection nozzle 22 is not perpendicular to the surface (polishing surface) 2*a* of the polishing pad 2, but is inclined at a predetermined angle toward the rotational direction side of the polishing table 1. In the case where an angle of the gas ejection direction of the gas ejection nozzle 22 with respect to the surface (polishing surface) 2*a* of the polishing pad 2, i.e., an angle between the surface (polishing surface) 2*a* of the polishing pad 2 and the gas ejection direction of the gas ejection nozzle 22 is defined as a gas approach angle (θ2), the gas approach angle (θ2) is set in the range of 30 to 50 degrees in connection with the nozzle cooling capacity (described later). Here, the gas ejection direction means a direction of a center line of an angle (gas ejection angle) which spreads out in a fan-like form from a gas ejection nozzle port.

The angle (θ1) of the gas ejection direction of the gas ejection nozzle 22 with respect to the tangential direction of rotation of the polishing pad and the angle (θ2) of the gas ejection direction of the gas ejection nozzle 22 with respect to the surface (polishing surface) 2*a* of the polishing pad 2 can be adjusted independently in each nozzle.

Further, as shown in FIG. 4, because the manifold 21 is configured to be vertically movable, the height (H) of the manifold 21 is variable so that the height of the gas ejection nozzle 22 from the polishing pad surface (polishing surface) 2*a* can be adjusted. In FIG. 1, the height of the nozzle port of the polishing liquid supply nozzle 3 from the surface of the polishing pad 2 and the height of the nozzle port of the gas ejection nozzle 22 from the surface of the polishing pad 2 are close to each other. In FIG. 3, although the case where the number of nozzles is eight is illustrated, the number of nozzles may be two or three, and the number of nozzles may be suitably selected according to the cooling capacity for cooling the polishing pad 2.

Further, as advanced variation, in some cases, the angle (θ1) of the gas ejection direction of the gas ejection nozzle, the gas approach angle (θ2) of the gas ejection nozzle, and the height (H) of the manifold 21 are fixed within respective preset ranges to prevent adjustment portions from being shifted in error and to prevent deviation from original preset positions. In that case, air ejection holes are formed directly in the manifold to take the form of the integration of the nozzles and the manifold.

Figure 5A:
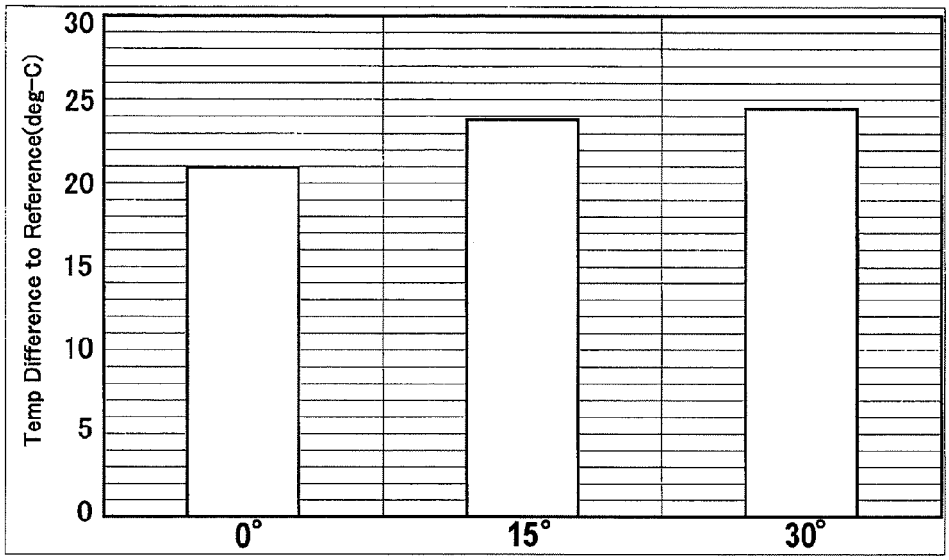
FIG. 5A is a graph showing cooling capacity in the case where the gas ejection direction of the gas ejection nozzle is not inclined with respect to the tangential direction of rotation of the polishing pad and in the case where the gas ejection direction of the gas ejection nozzle is inclined toward the pad center side with respect to the tangential direction of the rotation of the polishing pad.

FIG. 5A is a graph showing cooling capacity in the case where the gas ejection direction of the gas ejection nozzle 22 is not inclined with respect to the tangential direction of rotation of the polishing pad, i.e. θ1=0° and in the case where the gas ejection direction of the gas ejection nozzle 22 is inclined toward the pad center side with respect to the tangential direction of the rotation of the polishing pad, i.e. θ1=15° and θ1=30°. In FIG. 5A, the vertical axis represents the difference (° C.) between a pad temperature in the case of no cooling and a pad temperature in the case where the pad is cooled by using the nozzle, and this difference indicates the cooling capacity of the nozzle. As shown in FIG. 5A, as the angle (θ1) of the gas ejection direction of the gas ejection nozzle 22 with respect to the tangential direction of rotation of the polishing pad becomes larger, the cooling capacity is on a rising trend. However, if the angle (θ1) is too large, slurry dropping state is disturbed. Therefore, the angle (θ1) is preferably in the range of 15 to 35 degrees.

Figure 5B:
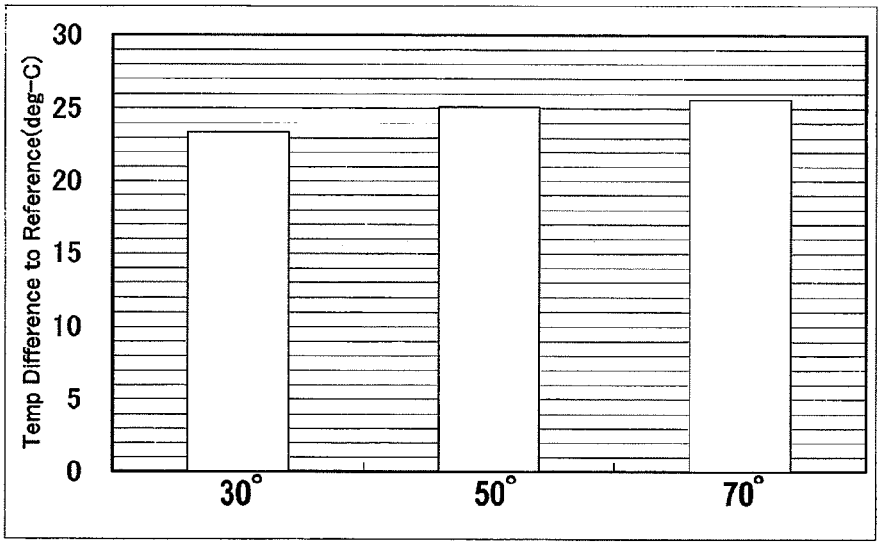
FIG. 5B is a graph showing the relationship between the gas approach angle representing an angle between the surface (polishing surface) of the polishing pad and the gas ejection direction of the gas ejection nozzle and cooling capacity.

FIG. 5B is a graph showing cooling capacity in the case where the gas approach angle (θ2) representing an angle between the surface (polishing surface) 2*a* of the polishing pad 2 and the gas ejection direction of the gas ejection nozzle 22 is 30 degrees, 50 degrees and 70 degrees. In FIG. 5B, the vertical axis represents the difference (° C.) between a pad temperature in the case of no cooling and a pad temperature in the case where the pad is cooled by using the nozzle, and this difference indicates the cooling capacity of the nozzle. As shown in FIG. 5B, as the gas approach angle (θ2) becomes larger, the cooling capacity is on a rising trend. However, if the angle (θ2) is too large, slurry dropping state is disturbed. Therefore, the angle (θ2) is preferably in the range of 30 to 50 degrees.

Figure 6:
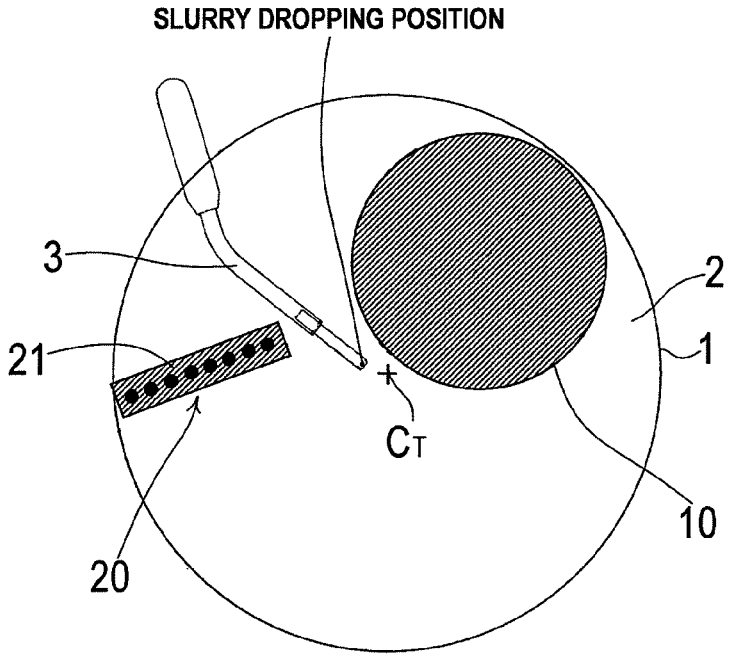
FIG. 6 is a plan view showing an example of the positional relationship between the polishing pad on the polishing table, the polishing liquid supply nozzle, the polishing head and the pad temperature control device.

FIG. 6 is a plan view showing an example of the positional relationship between the polishing pad 2 on the polishing table 1, the polishing liquid supply nozzle 3, the polishing head 10 and the pad temperature control device 20. As shown in FIG. 6, the polishing head 10 and the pad temperature control device 20 are disposed on opposite sides of the rotation center $C_T$ of the polishing table 1. Further, the polishing liquid supply nozzle 3 is disposed between the polishing head 10 and the pad temperature control device 20, and the slurry dropping position is located near the rotation center $C_T$ of the polishing table 1.

Figure 7:
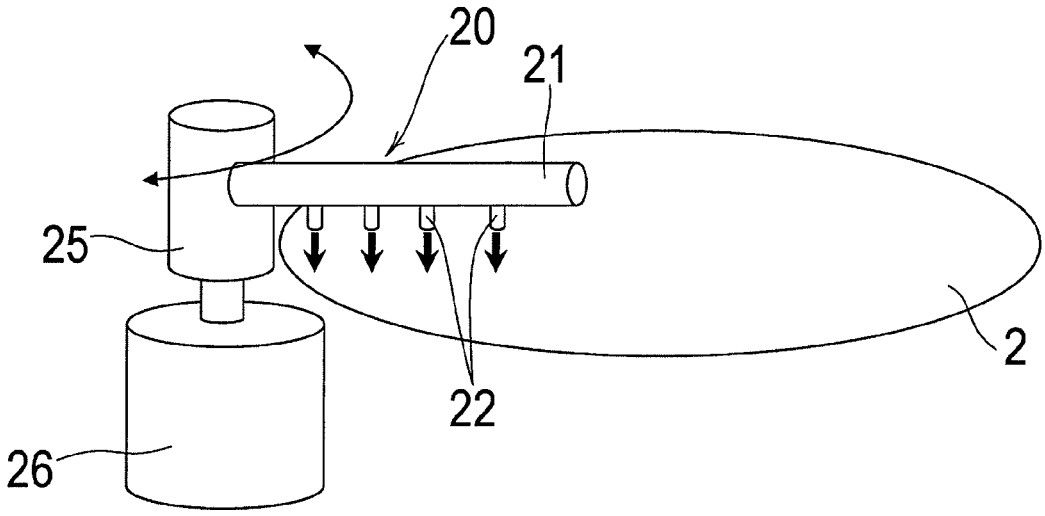
FIG. 7 is a perspective view showing the pad temperature control device having an oscillating mechanism for oscillating the manifold.

FIG. 7 is a perspective view showing the pad temperature control device 20 having an oscillating mechanism for oscillating the manifold 21. As shown in FIG. 7, the manifold 21 is fixed to a support post 25, and the support post 25 is coupled to a motor 26. By rotating the motor 26 in the normal direction or in the reverse direction, the manifold 21 can be oscillated (swung). Thus, the gas ejection nozzles 22 can be located at the respective optimum positions above the polishing pad 2. Further, if the gas ejection nozzles 22 are not used, the gas ejection nozzles 22 can be retracted from the location above the polishing pad 2.

Further, temperature profile of the polishing pad may be monitored by a thermography during polishing, and the manifold may be moved by oscillation so that high-temperature areas can be positively cooled in accordance with temperature distribution (for example, in the case where the temperature difference within the pad surface becomes a predetermined value or higher).

FIG. 8 is a table showing an example of a polishing recipe. As shown in FIG. 8, process time, rotational speed, . . . , Invalid or Valid of polishing pad temperature control and manifold oscillation, and temperature setting values may be registered as a polishing recipe according to the polishing steps 1, 2, 3 . . . , 10.

Next, an example of processes of polishing the substrate W using the polishing apparatus constructed as shown in FIGS. 1 through 8 will be described in detail.

First, a first preset temperature as a control target temperature of the polishing pad 2 is set in the temperature controller 31. Then, a supply pressure for supplying compressed air to the gas ejection nozzles 22 is confirmed. When this supply pressure is not more than a predetermined pressure, an alarm is issued and the subsequent process of the substrate is stopped. Only when the supply pressure is not less than the predetermined pressure, the polishing head 10 located at the substrate transfer position receives the substrate W from the pusher or the like and hold the substrate W under vacuum. Then, the substrate W held under vacuum by the polishing head 10 is moved horizontally from the substrate transfer position to the polishing position immediately above the polishing table 1.

Next, temperature monitoring of the polishing pad 2 by the radiation thermometer 32 is started. Then, the polishing liquid (slurry) is dropped from the polishing liquid supply nozzle 3 onto the polishing pad 2, and the polishing head 10 is lowered while the polishing head 10 is rotated to bring the surface (the surface to be polished) of the substrate W into contact with the polishing surface 2*a* of the rotating polishing pad 2. Then, attraction of the substrate W by the polishing head 10 is released, and the substrate W is pressed against the polishing surface 2*a* under a first polishing pressure. Thus, a main polishing step for polishing a metal film or the like on the substrate is started.

In the main polishing step, temperature control of the polishing pad 2 by the pad temperature control device 20 is started at the time when the substrate W is brought into contact with the polishing surface 2*a*. If the process in which the substrate W is brought into contact with the polishing surface 2*a* without rotating the polishing table 1 is employed, temperature control of the polishing pad 2 by the pad temperature control device 20 is started at the same time when rotation of the polishing table 1 is started.

Specifically, the temperature controller 31 controls the ratio of valve opening of the pressure regulating valve 30 based on the PID control according to the difference between the first preset temperature which has been preset and actual temperature of the polishing pad 2 detected by the radiation thermometer 32 to control a flow rate of compressed air ejected from the gas ejection nozzles 22. Thus, the temperature of the polishing pad 2 is controlled at the first preset temperature for obtaining the maximum polishing rate which has been determined in advance.

In this main polishing step, high polishing rate can be obtained by a combination of the high polishing pressure and cooling of the polishing pad 2, and hence the total polishing time can be shortened. This main polishing step is terminated, for example, when the film thickness measuring instrument 50 detects the state in which a thickness of a film such as a metal film reaches a predetermined value.

Next, a finish polishing step is performed. In the finish polishing step after the main polishing step, in order to place importance on improvement of the step height characteristics by preventing dishing, erosion or the like from occurring, it is necessary to control the temperature of the polishing pad 2. Specifically, a second preset temperature different from the first preset temperature is set in the temperature controller 31. After shifting to the finish polishing step, compressed air whose flow rate is controlled by the PID control so that the polishing pad 2 reaches the second preset temperature quickly is blown onto the polishing pad 2. For example, in the case where the second preset temperature in the finish polishing step is lower than the first preset temperature in the main polishing step, the flow rate of the compressed air is controlled at the maximum until the polishing pad 2 reaches the second preset temperature. In this manner, the temperature of the polishing pad 2 is controlled at the second preset temperature, and polishing is continued. In the finish polishing step, in order to improve the step height resolution characteristics mainly, the substrate W is pressed against the polishing surface 2*a* under the second polishing pressure which is lower than the first polishing pressure. This finish polishing step is terminated, for example, when the film thickness measuring instrument 50 detects the state in which a surplus metal film or the like located at areas other than trench or the like is polished and removed to expose a surface of an underlayer completely.

Next, ejection of the compressed air from the gas ejection nozzles 22 is stopped and supply of the polishing liquid (slurry) from the polishing liquid supply nozzle 3 is stopped, and then pure water (deionized water) is supplied onto the polishing pad 2 to conduct water polishing of the substrate W. Then, ejection of the compressed air from the gas ejection nozzles 22 is stopped, and the polished substrate W is detached from the polishing surface 2*a* and held under vacuum by the polishing head 10 while the compressed air is prevented from blowing against the substrate W. After that, the substrate W moves away from the polishing pad 2, and ejection of the compressed air from the gas ejection nozzles 22 remains at rest in order to prevent the polished surface of the substrate W from being dried due to blowing of the compressed air against the polished surface of the substrate W.

Next, the polishing head 10 which holds the substrate W under vacuum is lifted, and the substrate W is moved horizontally from the polishing position to the substrate transfer position. Then, the polished substrate W is transferred at the substrate transfer position to the pusher or the like. In the gas ejection nozzles 22, a cleaning liquid (water) is blown from cleaning nozzles (not shown) onto nozzle opening portions and their surrounding areas, thereby conducting cleaning of the gas ejection nozzles 22. Thus, dirt such as slurry attached to the gas ejection nozzles 22 can be prevented from falling onto the polishing pad 2 to avoid an adverse effect on the processing of the subsequent substrate.

In a state where the manifold 21 is moved to a retracting position by oscillating the manifold 21, a cleaning liquid is blown from cleaning nozzles (not shown) onto the gas ejection nozzles 22 to clean the gas ejection nozzles 22. Thus, dirt such as slurry attached to the gas ejection nozzles 22 can be prevented from falling onto the polishing pad 2.

Figure 9:
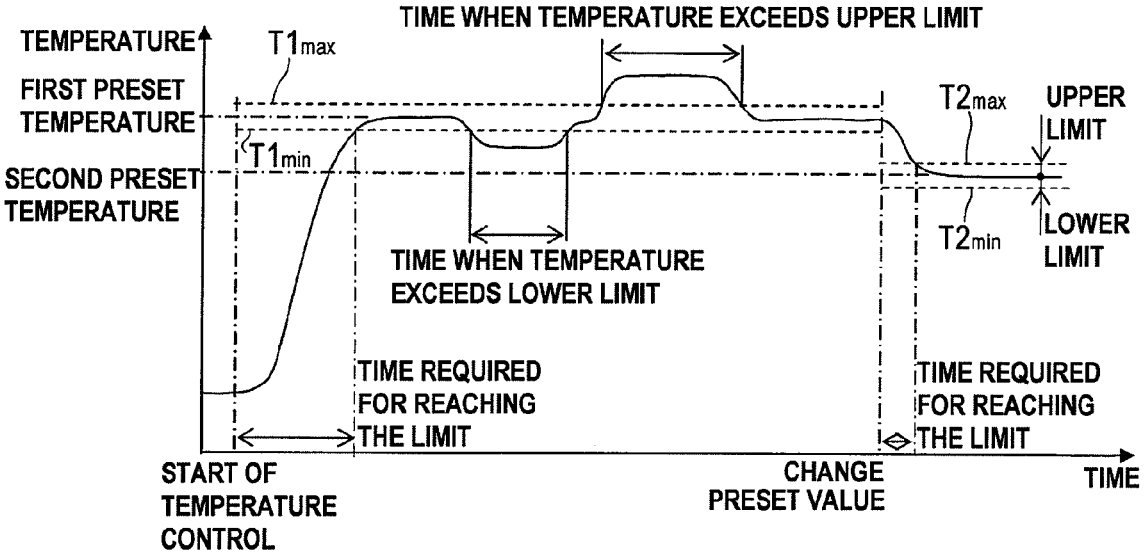
FIG. 9 is a graph showing an example of temperature control of the polishing pad in the polishing process comprising a main polishing step and a finish polishing step.

FIG. 9 is a graph showing an example of temperature control of the polishing pad 2 in the above polishing process. As shown in FIG. 9, the first preset temperature as a control target temperature of the polishing pad 2 is set in the temperature controller 31, and polishing of the substrate W is started and the temperature of the polishing pad 2 is monitored by the radiation thermometer 32 to start temperature control of the polishing pad 2 by the pad temperature control device 20. The temperature control is carried out by the PID control so that the temperature of the polishing pad 2 becomes within the range of the upper and lower limits ($T1_{max}$, $T1_{min}$) centering on the first preset temperature, and this compressed air whose flow rate is controlled is blown onto the polishing pad 2. Then, when the preset time (in normal case, i.e. in the case of no polishing abnormality, the preset time means the time from start of the temperature control to reaching the lower limit value of the first preset temperature, and this time is determined by experiments in advance) has elapsed, the temperature of the polishing pad and the lower limit of the first preset temperature are compared, and if the temperature of the polishing pad does not reach the lower limit of the first preset temperature, it is judged that polishing abnormality occurs and an alarm is issued by the temperature controller 31. The following alternative measures may be taken: The required time from start of the temperature control to reaching the lower limit ($T1_{min}$) of the first preset temperature is measured, and the required time and the preset time are compared, and if the required time is longer than the preset time, it is judged that polishing abnormality occurs and an alarm is issued.

After the temperature of the polishing pad 2 reaches the range of the first preset temperature (between the upper limit ($T1_{max}$) and the lower limit ($T1_{min}$)), if the time when the temperature of the polishing pad 2 exceeds the upper limit ($T1_{max}$) exceeds the preset time continuously, it is judged that polishing abnormality occurs and an alarm is issued. Further, if the time when the temperature of the polishing pad 2 is lower than the lower limit ($T1_{min}$) exceeds the preset time continuously, it is judged that polishing abnormality occurs and an alarm is issued.

While the presence or absence of the above polishing abnormality is monitored, the main polishing step is continued. Then, for example, when the film thickness measuring instrument 50 detects the state in which a thickness of a film such as a metal film reaches a predetermined value, the main polishing step is terminated, and then shifting to the finish polishing step. The finish polishing step is started by changing the preset value to the second preset temperature which is different from the first preset temperature. After shifting to the finish polishing step, compressed air whose flow rate is controlled by the PID control so that the polishing pad 2 reaches the second preset temperature quickly is blown onto the polishing pad 2. For example, in the case where the second preset temperature in the finish polishing step is lower than the first preset temperature in the main polishing step, the flow rate of the compressed air is controlled at the maximum until the polishing pad 2 reaches the second preset temperature. Then, after the preset temperature is changed from the first preset temperature to the second preset temperature, when the preset time (in normal case, i.e. in the case of no polishing abnormality, the preset time means the time from change of the first preset temperature to the second preset temperature to reaching the upper limit or the lower limit of the second preset temperature, and this time is determined by experiments in advance) has elapsed, the temperature of the polishing pad and the upper limit or the lower limit of the second preset temperature are compared, and if the temperature of the polishing pad does not reach the upper limit or the lower limit of the second preset temperature, it is judged that polishing abnormality occurs and an alarm is issued. The following alternative measures may be taken: The required time for reaching the upper limit ($T2_{max}$) or the lower limit ($T2_{min}$) of the second preset temperature is measured, and the required time and the preset time are compared, and if the required time is longer than the preset time, it is judged that polishing abnormality occurs and an alarm is issued.

After the temperature of the polishing pad 2 reaches the range of the second preset temperature (between the upper limit ($T2_{max}$) and the lower limit ($T2_{min}$)), if the time when the temperature of the polishing pad 2 exceeds the upper limit ($T2_{max}$) exceeds the preset time continuously, it is judged that polishing abnormality occurs and an alarm is issued. Further, if the time when the temperature of the polishing pad 2 is lower than the lower limit ($T2_{min}$) exceeds the preset time continuously, it is judged that polishing abnormality occurs and an alarm is issued.

While the presence or absence of the above polishing abnormality is monitored, the finish polishing step is continued. Then, for example, when the film thickness measuring instrument 50 detects the state in which a surplus metal film or the like located at areas other than trench or the like is polished and removed to expose a surface of an underlayer completely, the finish polishing step is finished.

When the error of the time when the temperature of the polishing pad does not reach the above preset temperature or the error of the time when the temperature of the polishing pad exceeds the upper and lower limits of the preset temperature occurs, the process interlock works, and thus polishing of the subsequent substrate is not performed. Therefore, defective product is limited to one substrate which has been polished at the time of occurrence of the error, thus contributing to improvement of production yield.

A polishing apparatus and method according to a second embodiment of the present invention will be described below with reference to FIGS. 10 through 29. Like or corresponding parts are denoted by like or corresponding reference numerals in FIGS. 10 through 29 and will not be described below repetitively.

Figure 10:
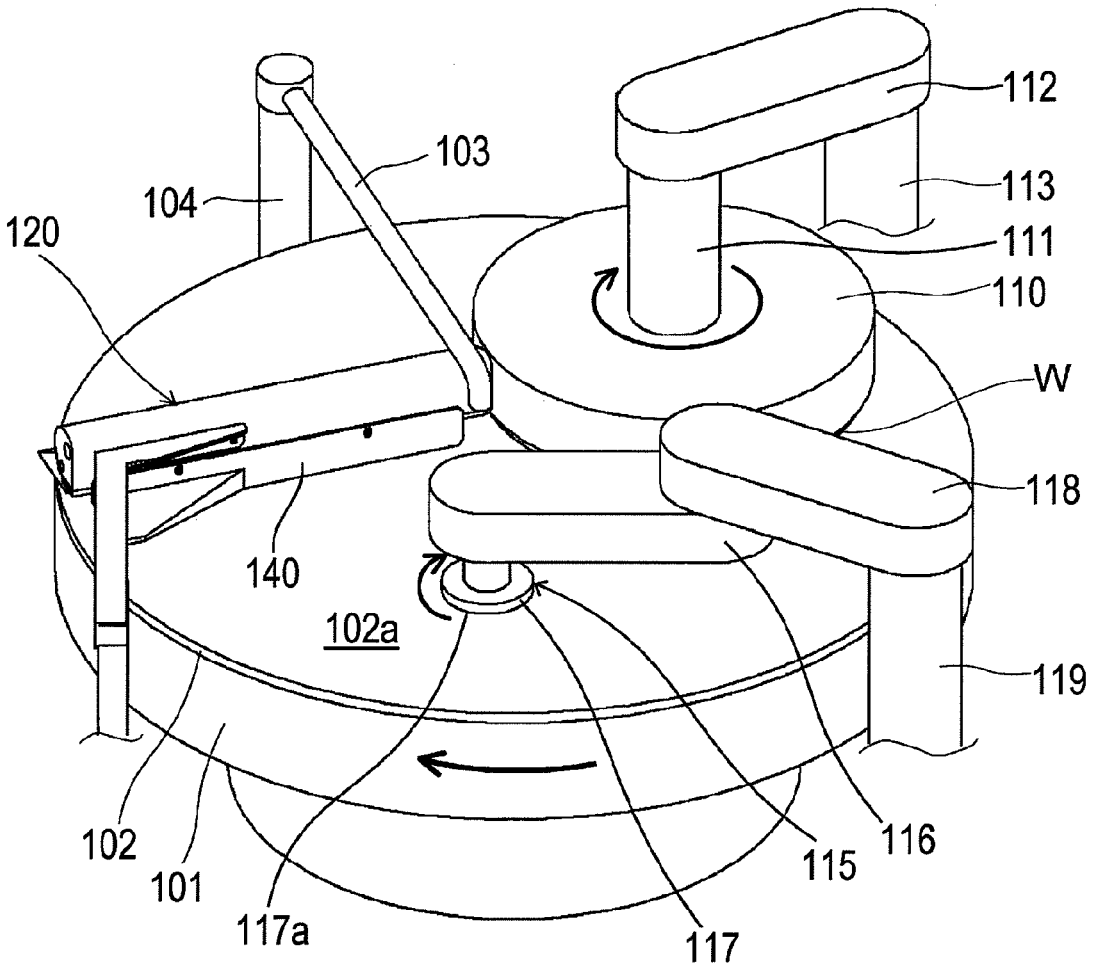
FIG. 10 is a schematic perspective view showing an entire structure of a polishing apparatus according to a second embodiment of the present invention.

FIG. 10 is a schematic perspective view showing an entire structure of a polishing apparatus according to a second embodiment of the present invention. As shown in FIG. 10, the polishing apparatus comprises a polishing table 101, and a top ring 110 for holding a substrate W such as a semiconductor wafer as an object to be polished and pressing the substrate against a polishing pad on the polishing table 101. The polishing table 101 is coupled via a table shaft to a polishing table rotating motor (not shown) disposed below the polishing table 101. Thus, the polishing table 101 is rotatable about the table shaft. A polishing pad 102 is attached to an upper surface of the polishing table 101. An upper surface of the polishing pad 102 constitutes a polishing surface 102*a* for polishing the substrate W. The polishing pad 102 comprising SUBA 800, IC-1000, IC-1000/SUBA400 (two-layer cloth), or the like manufactured by the Dow Chemical Company is used. The SUBA 800 is non-woven fabrics bonded by urethane resin. The IC-1000 comprises a pad composed of hard polyurethane foam and having a large number of fine holes formed in its surface, and is also called a perforated pad. A polishing liquid supply nozzle 103 is provided above the polishing table 101 to supply a polishing liquid (slurry) onto the polishing pad 102 on the polishing table 101. A rear end of the polishing liquid supply nozzle 103 is supported by a shaft 104, and the polishing liquid supply nozzle 103 is swingable about the shaft 104.

The top ring 110 is connected to a shaft 111, and the shaft 111 is vertically movable with respect to a support arm 112. When the shaft 111 moves vertically, the top ring 110 is lifted and lowered as a whole for positioning with respect to the support arm 112. The shaft 111 is configured to be rotated by operating a top ring rotating motor (not shown). The top ring 110 is rotated about the shaft 111 by rotation of the shaft 111.

The top ring 110 is configured to hold the substrate W such as a semiconductor wafer on its lower surface. The support arm 112 is configured to be pivotable about a shaft 113. Thus, the top ring 110, which holds the substrate W on its lower surface, is movable from a position at which the top ring 110 receives the substrate to a position above the polishing table 101 by pivotable movement of the support arm 112. Then, the top ring 110 holds the substrate W on its lower surface and presses the substrate W against the surface (polishing surface) 102*a* of the polishing pad 102. At this time, while the polishing table 101 and the top ring 110 are respectively rotated, a polishing liquid (slurry) is supplied onto the polishing pad 102 from the polishing liquid supply nozzle 103 provided above the polishing table 101. The polishing liquid containing silica ($SiO_2$) or ceria ($CeO_2$) as abrasive particles is used. In this manner, while the polishing liquid is supplied onto the polishing pad 102, the substrate W is pressed against the polishing pad 102 and is moved relative to the polishing pad 102 to polish an insulating film, a metal film or the like on the substrate.

As shown in FIG. 10, the polishing apparatus has a dressing apparatus 115 for dressing the polishing pad 102. The dressing apparatus 115 comprises a dresser arm 116, a dresser 117 which is rotatably attached to a forward end of the dresser arm 116, and a dresser head 118 coupled to the other end of the dresser arm 116. The lower part of the dresser 117 comprises a dressing member 117*a*, and the dressing member 117*a* has a circular dressing surface. Hard particles are fixed to the dressing surface by electrodeposition or the like. Examples of the hard particles include diamond particles, ceramic particles and the like. A motor (not shown) is provided in the dresser arm 116, and the dresser 117 is rotated by the motor. The dresser head 118 is supported by a shaft 119.

When the polishing surface 102*a* of the polishing pad 2 is dressed, the polishing pad 102 is rotated and the dresser 117 is rotated by the motor, and then the dresser 117 is lowered by a lifting and lowering mechanism to bring the dressing member 117*a* provided at the lower surface of the dresser 117 into sliding contact with the polishing surface of the rotating polishing pad 102. In this state, the dresser arm 116 is oscillated (swung), and thus the dresser 117 located at the forward end of the dresser arm 116 can move transversely from the outer circumferential end to the central part of the polishing surface of the polishing pad 102. By this swing motion, the dressing member 117*a* can dress the polishing surface of the polishing pad 102 over the entire surface including the central part.

As shown in FIG. 10, the polishing apparatus has a pad adjustment apparatus 120 which comprises a pad temperature control mechanism for controlling a temperature of the surface (polishing surface) 102*a* of the polishing pad 102 by blowing a gas on the polishing pad 102, and an atomizer for removing foreign matters on the polishing pad 102 by blowing a liquid such as pure water (deionized water) on the polishing pad 102. The pad temperature control mechanism and the atomizer are juxtaposed. The pad adjustment apparatus 120 is disposed above the polishing pad 102 in parallel to the surface (polishing surface) 102*a* of the polishing pad 102 and extends along substantially radial direction of the polishing pad 102.

Figure 11:
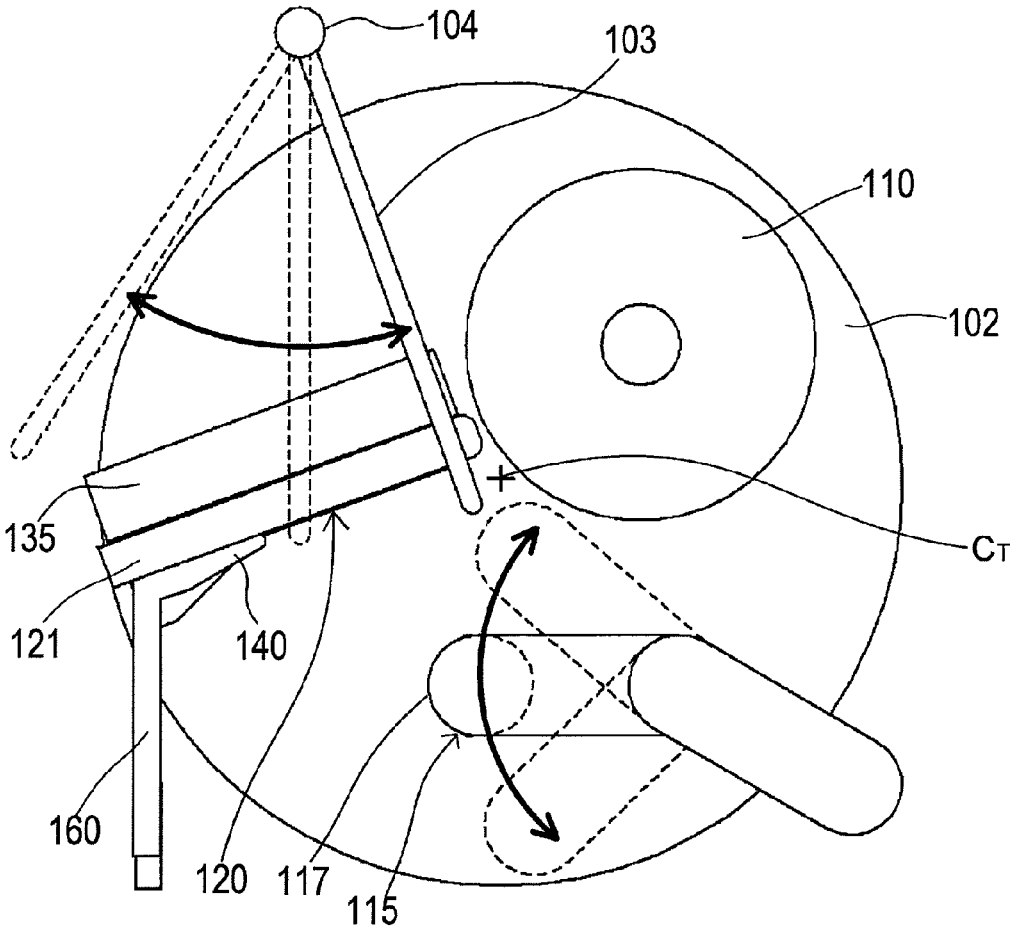
FIG. 11 is a plan view showing the relationship between the polishing pad on the polishing table, the polishing liquid supply nozzle, the top ring, the dresser and the pad adjustment apparatus.

FIG. 11 is a plan view showing the relationship between the polishing pad 102 on the polishing table 101, the polishing liquid supply nozzle 103, the top ring 110, the dresser 117 and the pad adjustment apparatus 120. As shown in FIG. 11, the top ring 110, the dressing apparatus 115 and the pad adjustment apparatus 120 are disposed so as to divide a space on the polishing pad 102 into three parts in a circumferential direction of the polishing pad 102 about a rotation center $C_T$ of the polishing table 101. The top ring 110 and the pad adjustment apparatus 120 are disposed on the opposite sides across the rotation center $C_T$ of the polishing table 101. Further, the polishing liquid supply nozzle 103 is disposed adjacent to the top ring 110 and the pad adjustment apparatus 120, and slurry dropping position is set to a position near the rotation center $C_T$ of the polishing table 101. The polishing liquid supply nozzle 103 is swingable about the shaft 104 so that the polishing liquid (slurry) dropping position can be changed during polishing.

Figure 12:
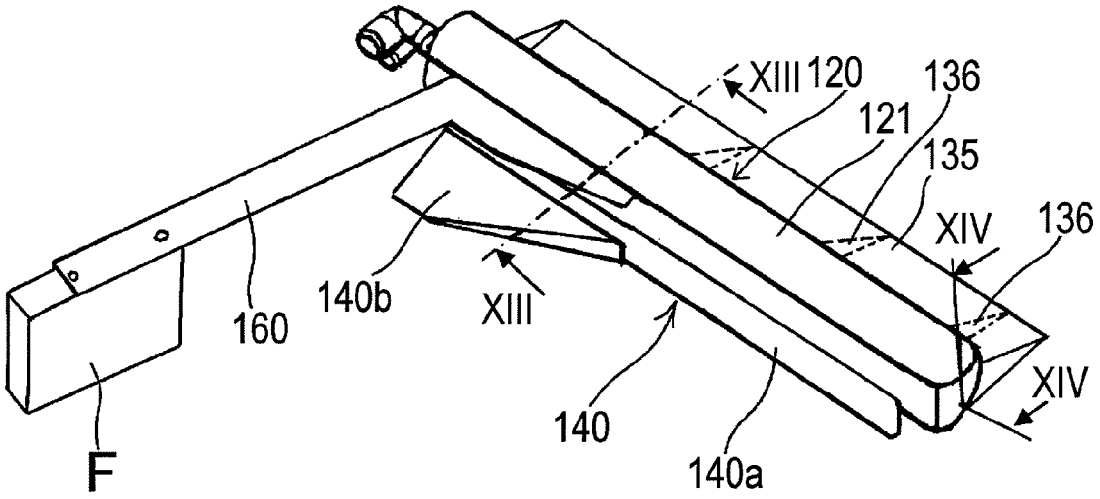
FIG. 12 is a perspective view of the pad adjustment apparatus.

Next, detailed structure of the pad adjustment apparatus 120 will be described below with reference to FIGS. 12 through 14. FIG. 12 is a perspective view of the pad adjustment apparatus 120. As shown in FIG. 12, the pad adjustment apparatus 120 comprises a main body portion 121 comprising a beam-like member which is disposed above the polishing pad 102 and extends along substantially radial direction of the polishing pad 102 from the outer circumferential portion to the central portion of the polishing pad 102, a gas ejection nozzle cover 135 fixed to one side of the main body portion 121, and a scattering-prevention cover 140 fixed to the other side of the main body portion 121. Further, the main body portion 121 is fixed to an apparatus frame F or the like by a fixing arm 160 extending to the outside of the polishing table 101.

Figure 13:
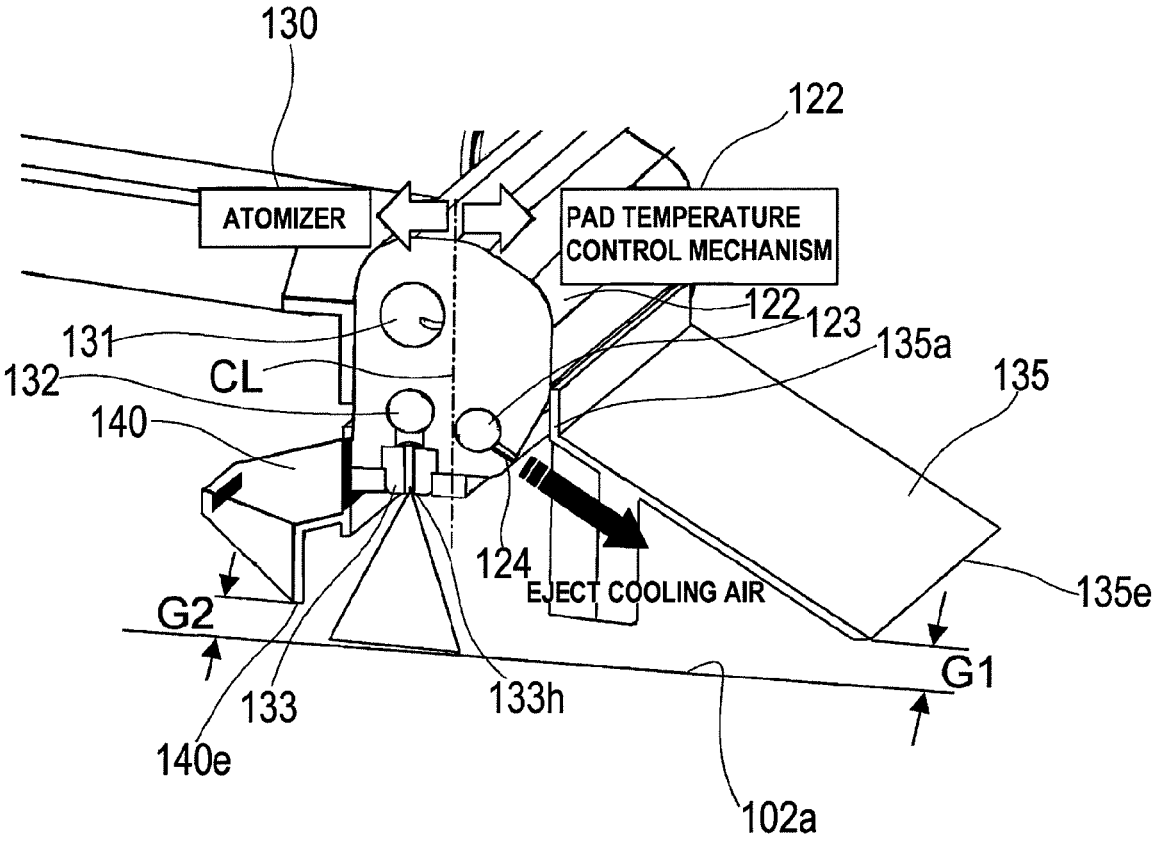
FIG. 13 is a cross-sectional view taken along line XIII-XIII of FIG. 12.

FIG. 13 is a cross-sectional view taken along line XIII-XIII of FIG. 12. As shown in FIG. 13, the main body portion 121 has a substantially rectangular cross-section, and a pad temperature control mechanism 122 for controlling a temperature of the surface (polishing surface) 102*a* of the polishing pad 102 by blowing a gas on the polishing pad 102 and an atomizer 130 for removing foreign matters on the polishing pad 102 by blowing a liquid such as pure water on the polishing pad 102 are provided in parallel in the main body portion 121. Specifically, the pad temperature control mechanism 122 and the atomizer 130 are formed as an integral unit. In FIG. 13, in the case where an alternate long and short dash line drawn vertically at a substantially central part of the main body portion 121 is taken as a centerline CL, the pad temperature control mechanism 122 is disposed on the right side of the centerline CL, and the atomizer 130 is disposed on the left side of the centerline CL. The pad temperature control mechanism 122 has a fluid supply passage 123 comprising a circular hole formed in the main body portion 121, and the fluid supply passage 123 is configured to be supplied with compressed air from a compressed air supply source (not shown). The fluid supply passage 123 extends in a longitudinal direction of the main body portion 121 to a base end portion of the main body portion 121. A plurality of gas ejection nozzles 124 are formed obliquely downward of the fluid supply passage 123, and the gas ejection nozzles 124 are configured to eject compressed air and to blow the compressed air onto the surface (polishing surface) 102*a* of the polishing pad 102. The gas ejection nozzles 124 comprise nozzle holes communicating with the fluid supply passage 123, and these nozzle holes are composed of circular through-holes or oval through-holes. The gas ejection nozzles 124 are formed at predetermined intervals along the longitudinal direction of the main body portion 121.

On the other hand, the atomizer has fluid supply passages 131 and 132 comprising circular holes formed at upper and lower parts in the main body portion 121, and the upper fluid supply passage 131 is connected to a pure water source (not shown) and the lower fluid supply passage 132 communicates with the upper fluid supply passage 131. The upper and lower fluid supply passages 131 and 132 extend in a longitudinal direction of the main body portion 121 to the base end portion of the main body portion 121. Then, a plurality of nozzles 133 are disposed below the lower fluid supply passage 132 at predetermined intervals along the longitudinal direction of the main body portion 121. Each of the nozzles 133 has a nozzle hole 133*h* having a small diameter, and the nozzle hole 133*h* extends downwardly so as to be substantially perpendicular to the surface (polishing surface) 102*a* of the polishing pad 102. Pure water (deionized water) supplied from the pure water source to the upper fluid supply passage 131 is supplied via the lower fluid supply passage 132 to the nozzles 133.

As shown in FIG. 13, the fluid supply passage for supplying pure water to the nozzles 133 is divided into the upper fluid supply passage 131 and the lower fluid supply passage 132, and the cross-sectional area of the lower fluid supply passage 132 is set to be smaller than the cross-sectional area of the upper fluid supply passage 131. In this manner, because pure water is supplied from the upper fluid supply passage 131 via the lower fluid supply passage 132 to the nozzles 133 and is then ejected from the small-diameter nozzle holes 133*h*, the cross-sectional areas of the fluid passages from the upper fluid supply passage 131 through the lower fluid supply passage 132 to the nozzles 133 are becoming gradually narrower to restrict the flow of the fluid gradually. Thus, a fluid passage loss can be minimized, and the pure water can be efficiently blown from the nozzles 133 onto the polishing pad 102.

A liquid such as pure water may be supplied from a liquid source to the upper fluid supply passage 131 and a gas such as nitrogen (N2) gas may be supplied from a gas source to the lower fluid supply passage 132, and after mixing the liquid and the gas in a mixing space provided in the main body portion 121, a gas-liquid mixed fluid may be ejected from the nozzles 133.

Figure 14:
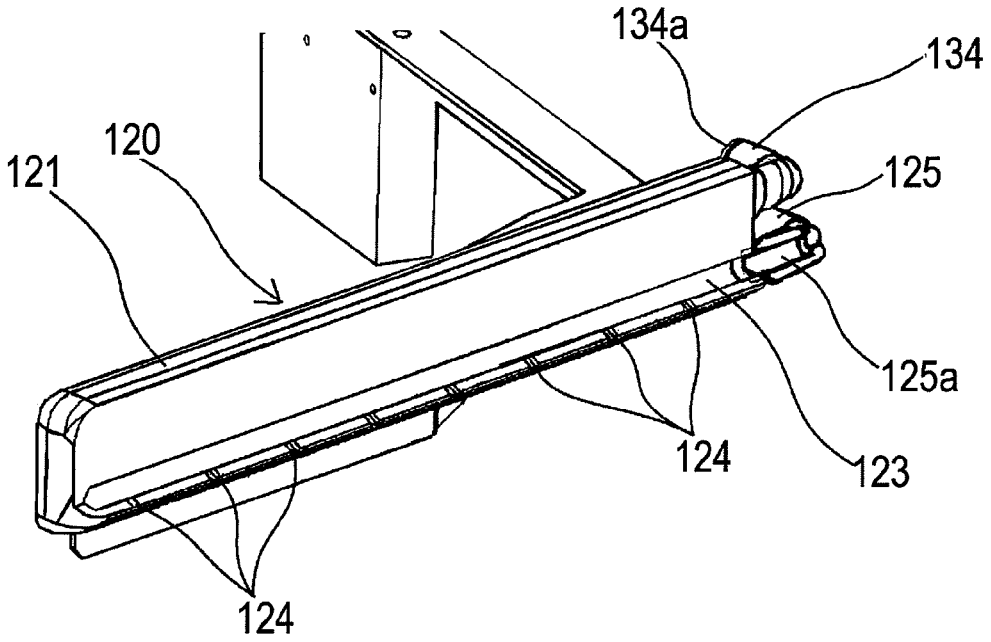
FIG. 14 is a cross-sectional view taken along line XIV-XIV of FIG. 12.

FIG. 14 is a cross-sectional view taken along line XIV-XIV of FIG. 12. As shown in FIG. 14, the fluid supply passage 123 extending in a longitudinal direction of the main body portion 121 is formed in the main body portion 121. The fluid supply passage 123 extends to the base end portion of the main body portion 121, and a joint 125 having a compressed air supply port 125*a* is fixed to an opening end of the fluid supply passage 123. A plurality of gas ejection nozzles 124 are formed at predetermined intervals along the longitudinal direction of the main body portion 121.

Although not shown in FIG. 14, the upper and lower fluid supply passages 131 and 132 of the atomizer 130 also extend in a longitudinal direction of the main body portion 121. The upper fluid supply passage 131 extends to the base end portion of the main body portion 121, and a joint 134 having a pure water supply port 134*a* is fixed to an opening end of the upper fluid supply passage 131.

Further, the fluid supply passages 123, 131 and 132 may be integrated into a single common fluid supply passage, and the gas ejection nozzles 124 and the nozzles 133 may be provided in the single fluid supply passage, and then opening and closing between the fluid supply sources (compressed air source, pure water source and the like) and the respective nozzle holes may be switched.

Next, the gas ejection nozzle cover 135 fixed to one side of the main body portion 121 and the scattering-prevention cover 140 fixed to the other side of the main body portion 121 will be described below.

As shown in FIG. 12, the gas ejection nozzle cover 135 is attached to one side of the main body portion 121 and extends at the side of the main body portion 121 from the forward end portion to the rear end portion of the main body portion 121. A plurality of triangle-shaped gas direction adjustment plates 136 are provided on the lower surface of the gas ejection nozzle cover 135 (described later). As shown in FIG. 13, the gas ejection nozzle cover 135 is fixed to the main body portion 121 at a location slightly above the gas ejection nozzles 124 and extends obliquely downward along gas ejection direction of the gas ejection nozzles 124. Specifically, the gas ejection nozzle cover 135 extends obliquely downward from a fixing part 135*a* located slightly above the gas ejection nozzles 124, and becomes closer to the polishing surface 102*a* of the polishing pad 102 as the gas ejection nozzle cover 135 becomes more distant from the fixing part 135*a*. However, there is a gap G1 between the forward end 135*e* of the gas ejection nozzle cover 135 and the polishing surface 102*a* of the polishing pad 102, and thus a flow passage of ejected air (compressed air) is ensured.

Further, as shown in FIGS. 12 and 13, the scattering-prevention cover 140 is attached to the main body portion 121 at the other side of the gas ejection nozzle cover 135. The scattering-prevention cover 140 comprises a forepart cover 140*a* extending downwardly from a forward end part to a substantially central part of the main body portion 121, and a rear part cover 140*b* extending horizontally in a triangular geometry and then extending downwardly at the location from a substantially central part to a rear part of the main body portion 121. However, there is a gap G2 between the lower end 140*e* of the scattering-prevention cover 140 and the polishing surface 102*a* of the polishing pad 102, and thus a flow passage of ejected pure water is ensured. The rear part cover 140*b* may have a shape extending horizontally at the location from the forward end part to the rear end part of the main body portion 121.

Figure 15:
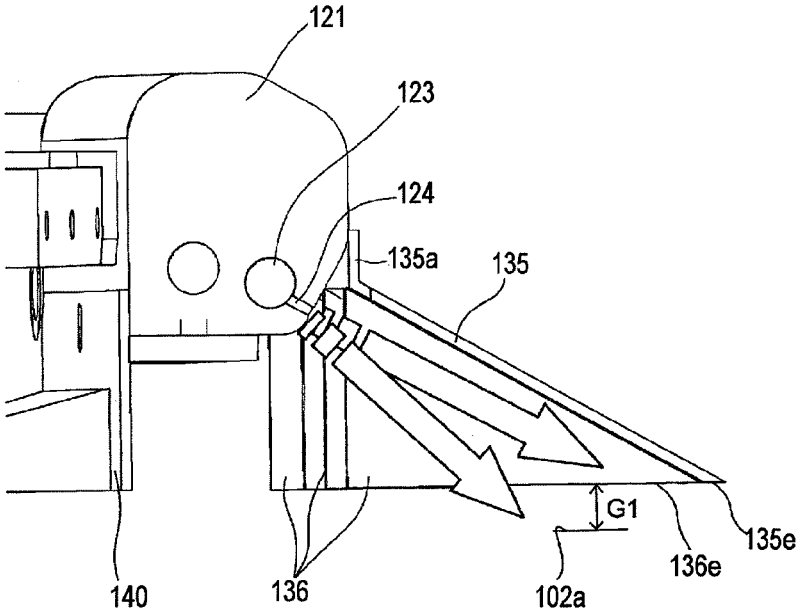
FIG. 15 is a view showing the gas direction adjustment plates provided on the lower surface of the gas ejection nozzle cover.

FIG. 15 is a view showing the gas direction adjustment plates 136 provided on the lower surface of the gas ejection nozzle cover 135. As shown in FIG. 15, a plurality of triangle-shaped gas direction adjustment plates 136 are provided at predetermined intervals on the lower surface of the gas ejection nozzle cover 135. Each of the gas direction adjustment plates 136 comprises a triangle-shaped plate extending in a vertical direction toward the polishing pad 102. The lower ends 136*e* of the gas direction adjustment plates 136 and the forward end 135*e* of the gas ejection nozzle cover 135 are located in the same plane, and there is a gap G1 between the lower ends 136*e* of the gas direction adjustment plates 136 and the polishing surface 102*a* of the polishing pad 102. In this manner, by providing a plurality of gas direction adjustment plates 136 on the lower surface of the gas ejection nozzle cover 135, air (compressed air) ejected from the gas ejection nozzles 124 can be adjusted (controlled) so as to flow in a predetermined direction.

In the embodiment shown in FIGS. 12 through 15, by providing the pad temperature control mechanism 122 comprising the fluid supply passage 123 and the gas ejection nozzles 124, and the atomizer 130 comprising the fluid supply passages 131 and 132 and the nozzles 133 in the main body portion 121 comprising a beam-like member, the pad temperature control mechanism 122 and the atomizer 130 are formed into an integral unit. However, the following alternative measures may be taken: The fluid supply passage 123 comprises a pipe and the gas ejection nozzles 124 comprise separate nozzles fixed to the fluid supply passage 123, thereby forming the pad temperature control mechanism 122. Further, the fluid supply passage 131 and the fluid supply passage 132 comprise pipes, respectively, and these pipes are configured to communicate with each other by a short pipe, and then the nozzles 133 comprise separate nozzles fixed to the fluid supply passage 132, thereby forming the atomizer 130. Then, the pad temperature control mechanism 122 and the atomizer 130 are housed in a cover, thereby forming the pad temperature control mechanism 122 and the atomizer 130 into an integral unit.

Figure 16:
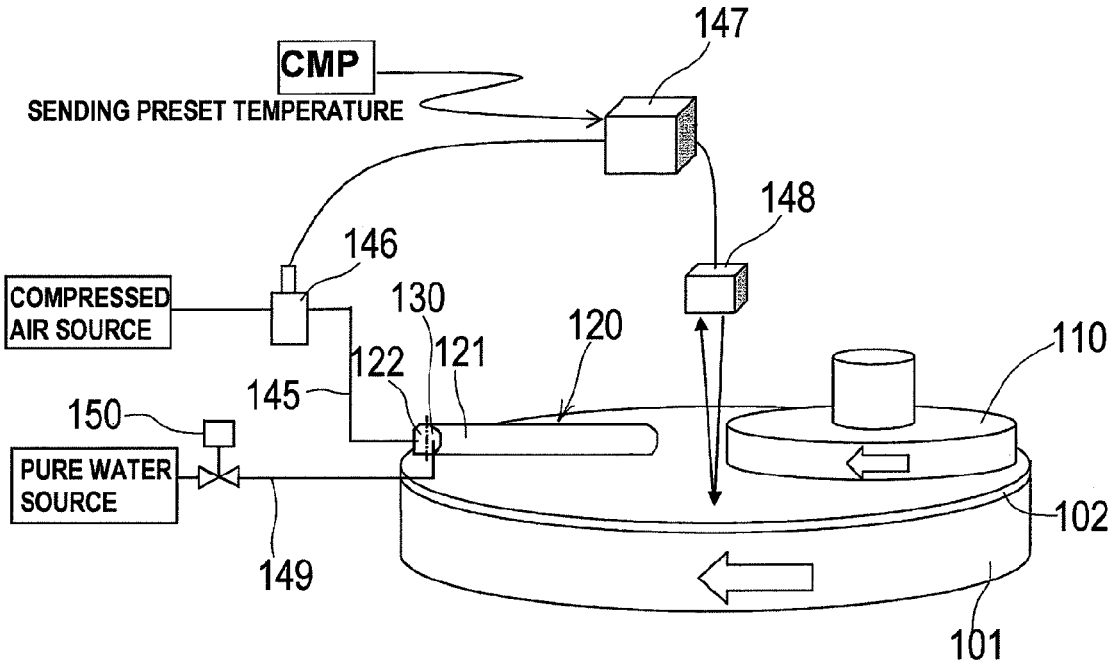
FIG. 16 is a perspective view showing control equipment of the pad temperature control mechanism and the atomizer in the pad adjustment apparatus.

FIG. 16 is a perspective view showing control equipment of the pad temperature control mechanism 122 and the atomizer 130 in the pad adjustment apparatus 120. As shown in FIG. 16, the polishing pad 102 is attached to the upper surface of the polishing table 101. The top ring 110 is disposed above the polishing pad 102, and the top ring 110 is configured to hold the substrate W (see FIG. 10) and to press the substrate W against the polishing pad 102. The pad temperature control mechanism 122 is connected to a compressed air source by a compressed air supply line 145. A pressure regulating valve 146 is provided in the compressed air supply line 145, and the compressed air supplied from the compressed air source passes through the pressure regulating valve 146, thereby regulating a pressure and a flow rate of the compressed air. The pressure regulating valve 146 is connected to a temperature controller 147. The compressed air may be a normal temperature or may be cooled to a predetermined temperature.

As shown in FIG. 16, a radiation thermometer 148 for detecting a surface temperature of the polishing pad 102 is provided above the polishing pad 102. The radiation thermometer 148 is connected to a temperature controller 147. Preset temperatures which are control objective temperatures of the polishing pad 102 are inputted into the temperature controller 147 from a CMP controller for controlling the entirety of the polishing apparatus. Further, the preset temperatures may be directly inputted into the temperature controller 147. The temperature controller 147 controls a ratio of valve opening of the pressure regulating valve 146 on the basis of the PID control in response to the difference between the preset temperature of the polishing pad 102 inputted into the temperature controller 147 and the actual temperature of the polishing pad 102 detected by the radiation thermometer 148, thereby controlling a flow rate of the compressed air ejected from the gas ejection nozzles 124. With this arrangement, the compressed air is blown at the optimum flow rate from the gas ejection nozzles 124 onto the polishing surface 102*a* of the polishing pad 102, and hence the temperature of the polishing surface 102*a* of the polishing pad 102 can be maintained at the target temperature (preset temperature) which has been preset in the temperature controller 147.

As shown in FIG. 16, the atomizer 130 is connected to a pure water supply source by a pure water supply line 149. A control valve 150 is provided in the pure water supply line 149. Control signals are inputted from the CMP controller into the control valve 150 to control a flow rate of pure water ejected from the nozzles 133 (see FIG. 13). Thus, pure water is sprayed at the optimum flow rate onto the polishing surface 102*a* of the polishing pad 102 to remove foreign matters (polishing pad chips, polishing liquid fixation, and the like) on the polishing pad. In the case where a gas-liquid mixed fluid is ejected from the nozzles 133, the atomizer 130 is connected also to a gas source.

Figure 17:
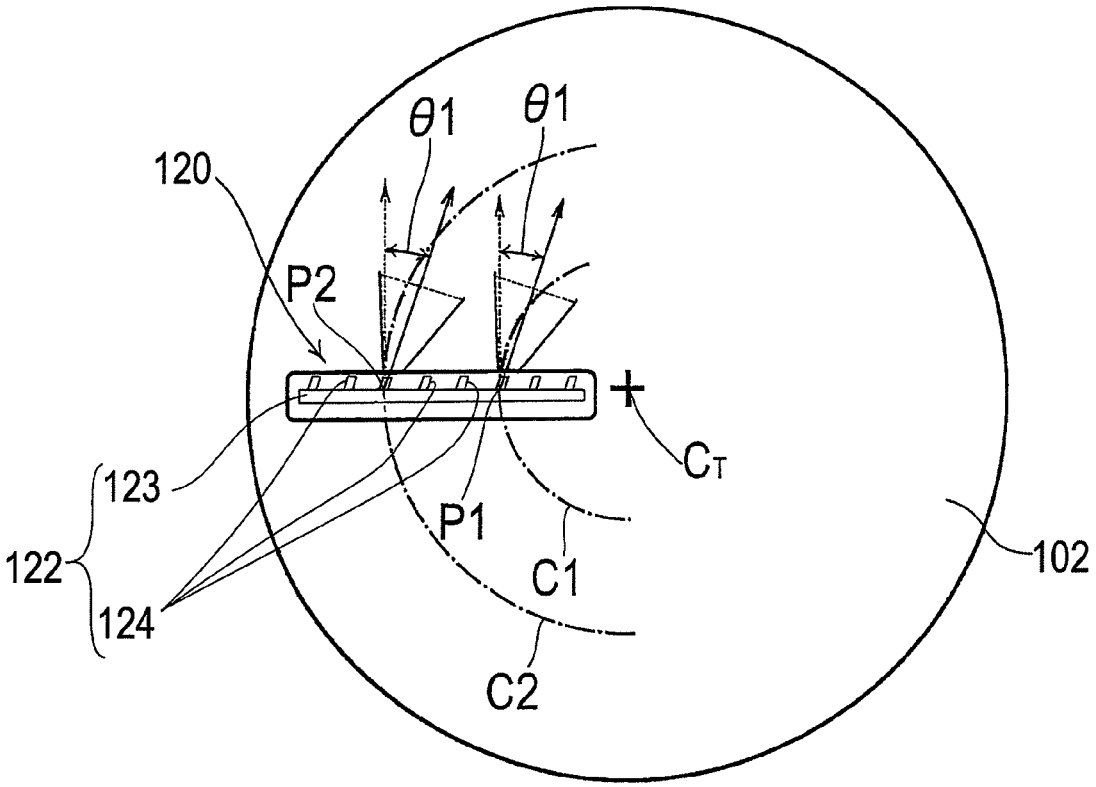
FIG. 17 is a schematic plan view showing the relationship between the gas ejection nozzles of the pad temperature control mechanism and the polishing pad.
Figure 18:
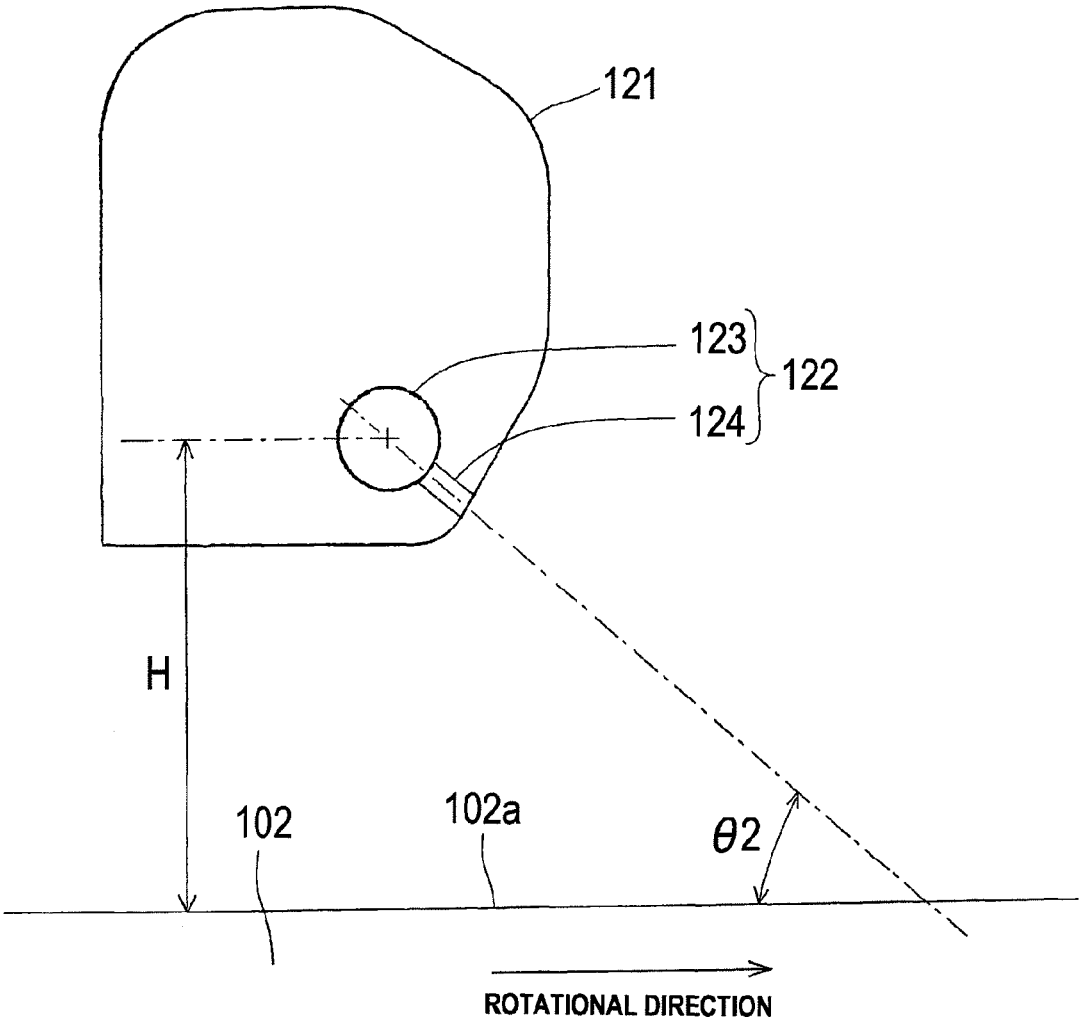
FIG. 18 is a schematic side view showing the relationship between the gas ejection nozzles of the pad temperature control mechanism and the polishing pad.

FIGS. 17 and 18 are views showing the relationship between the gas ejection nozzles 124 of the pad temperature control mechanism 122 and the polishing pad 102, and FIG. 17 is a schematic plan view and FIG. 18 is a schematic side view. In FIGS. 17 and 18, illustration of the atomizer 130 is omitted. As shown in FIG. 17, the pad temperature control mechanism 122 comprises a plurality of gas ejection nozzles 124 disposed at predetermined intervals in a longitudinal direction of the main body portion 121 (eight nozzles are attached in the illustrated example). During polishing, the polishing pad 102 rotates in a clockwise direction about a rotation center $C_T$. In FIG. 17, the nozzles are numbered in ascending sequence of 1, 2, 3, . . . 8 from the inner side of the polishing pad, and the two gas ejection nozzles 124 of the third and sixth ones as an example will be described. Specifically, in the case where concentric circles C1 and C2 which pass through points P1 and P2, respectively, located immediately below the two gas ejection nozzles 124 of the third and sixth ones and are centered around the rotation center $C_T$ are assumed, and tangential directions in the respective points P1 and P2 on the respective concentric circles C1 and C2 are defined as tangential directions of rotation of the polishing pad, gas ejection directions of the gas ejection nozzles 124 are inclined at a predetermined angle (θ1) toward the pad center side with respect to the tangential directions of rotation of the polishing pad. The gas ejection direction means a direction of a center line of an angle (gas ejection angle) which spreads out in a fan-like form from a gas ejection nozzle port. Other nozzles besides the third and sixth nozzles are inclined at the predetermined angle (θ1) toward the pad center side with respect to the tangential directions of rotation of the polishing pad in the same manner. Then, the angle (θ1) of the gas ejection direction of the gas ejection nozzle 124 with respect to the tangential direction of rotation of the polishing pad is set in the range of 15 to 35 degrees in connection with nozzle cooling capacity (described later). Although the case where a plurality of nozzles are provided has been described, a single nozzle may be provided.

Further, as shown in FIG. 18, the gas ejection direction of the gas ejection nozzle 124 is not perpendicular to the surface (polishing surface) 102*a* of the polishing pad 102, but is inclined at a predetermined angle toward the rotational direction side of the polishing table 101. In the case where an angle of the gas ejection direction of the gas ejection nozzle 124 with respect to the surface (polishing surface) 102*a* of the polishing pad 102, i.e., an angle between the surface (polishing surface) 102*a* of the polishing pad 102 and the gas ejection direction of the gas ejection nozzle 124 is defined as a gas approach angle (θ2), the gas approach angle (θ2) is set in range of 30 to 50 degrees in connection with the nozzle cooling capacity (described later). Here, the gas ejection direction means a direction of a center line of an angle (gas ejection angle) which spreads out in a fan-like form from a gas ejection nozzle port.

Further, as shown in FIG. 18, because the main body portion 121 is configured to be vertically movable, the height (H) of the main body portion 121 is variable so that the height of the gas ejection nozzle 124 from the polishing pad surface (polishing surface) 102*a* can be adjusted. In FIG. 17, although the case where the number of the gas ejection nozzles 124 is eight is illustrated, the number of nozzles may be adjusted by blocking nozzle holes with plugs or the like. In some cases, two or three nozzles are provided. The number of nozzles may be suitably selected according to the cooling capacity for cooling the polishing pad 102.

Figure 19A:
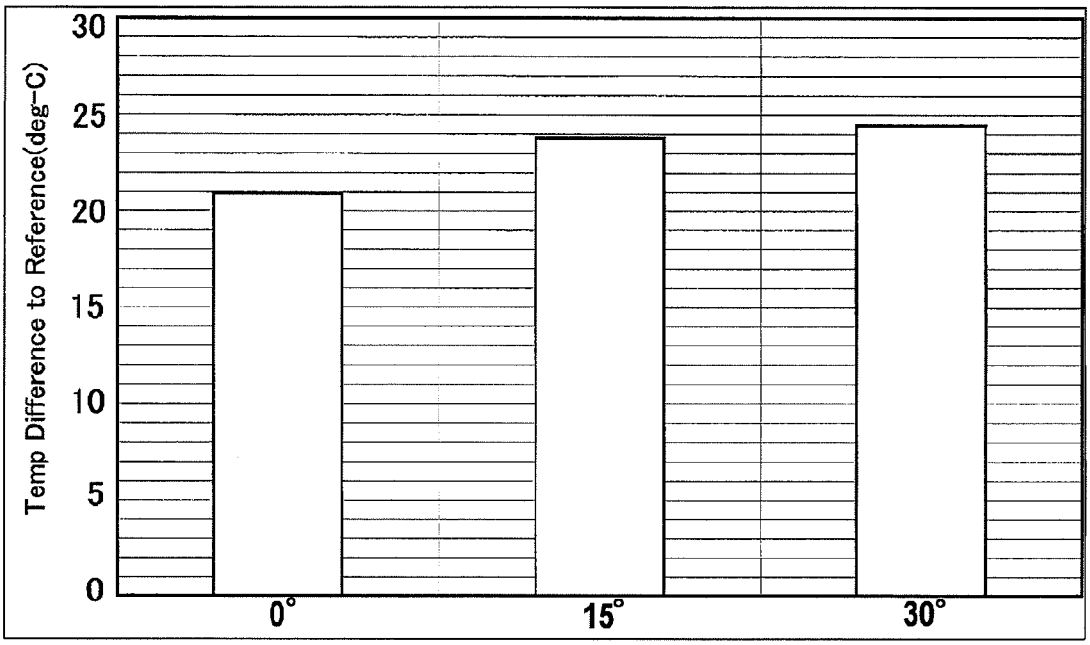
FIG. 19A is a graph showing cooling capacity in the case where the gas ejection direction of the gas ejection nozzle is not inclined with respect to the tangential direction of rotation of the polishing pad and in the case where the gas ejection direction of the gas ejection nozzle is inclined toward the pad center side with respect to the tangential direction of the rotation of the polishing pad.

FIG. 19A is a graph showing cooling capacity in the case where the gas ejection direction of the gas ejection nozzle 124 is not inclined with respect to the tangential direction of rotation of the polishing pad, i.e. θ1=0° and in the case where the gas ejection direction of the gas ejection nozzle 124 is inclined toward the pad center side with respect to the tangential direction of the rotation of the polishing pad, i.e. θ1=15° and θ1=30°. In FIG. 19A, the vertical axis represents the difference (° C.) between pad temperature in the case of no cooling and pad temperature in the case where the pad is cooled using the nozzle, and this difference indicates the cooling capacity of the nozzle. As shown in FIG. 19A, as the angle (θ1) of the gas ejection direction of the gas ejection nozzle 124 with respect to the tangential direction of rotation of the polishing pad becomes larger, the cooling capacity is on a rising trend. However, if the angle (θ1) is too large, slurry dropping state is disturbed. Therefore, the angle (θ1) is preferably in the range of 15 to 35 degrees.

Figure 19B:
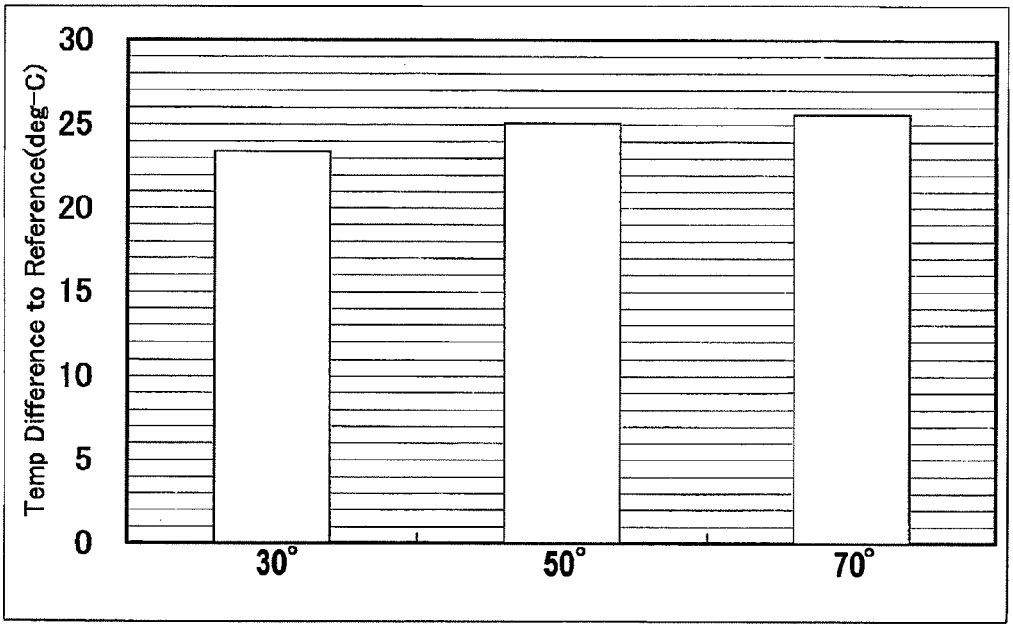
FIG. 19B is a graph showing the relationship between the gas approach angle representing the angle between the surface (polishing surface) of the polishing pad and the gas ejection direction of the gas ejection nozzle and cooling capacity.

FIG. 19B is a graph showing cooling capacity in the case where the gas approach angle (θ2) representing the angle between the surface (polishing surface) 102*a* of the polishing pad 102 and the gas ejection direction of the gas ejection nozzle 124 is 30 degrees, 50 degrees and 70 degrees. In FIG. 19B, the vertical axis represents the difference (° C.) between pad temperature in the case of no cooling and pad temperature in the case where the pad is cooled using the nozzle, and this difference indicates the cooling capacity of the nozzle. As shown in FIG. 19B, as the gas approach angle (θ2) of the gas ejection nozzle becomes larger, the cooling capacity is on a rising trend. However, the angle (θ2) is too large, slurry dropping state is disturbed. Therefore, the angle (θ2) is preferably in the range of 30 to 50 degrees.

Next, a method of controlling a flow of the polishing liquid (slurry) on the polishing pad 102 by the gas direction adjustment plates 136 for controlling a flow direction of air (compressed air) ejected from the gas ejection nozzles 124 of the pad temperature control mechanism 122 will be described in detail.

Figure 20A:
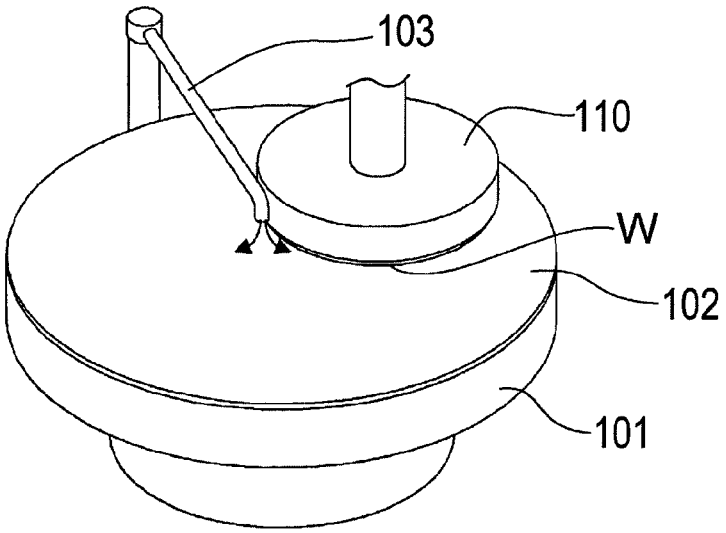
FIGS. 20A, 20B and 20C are views showing flows of the polishing liquid (slurry) which has been dropped from the polishing liquid supply nozzle onto the polishing pad.
Figure 20B:
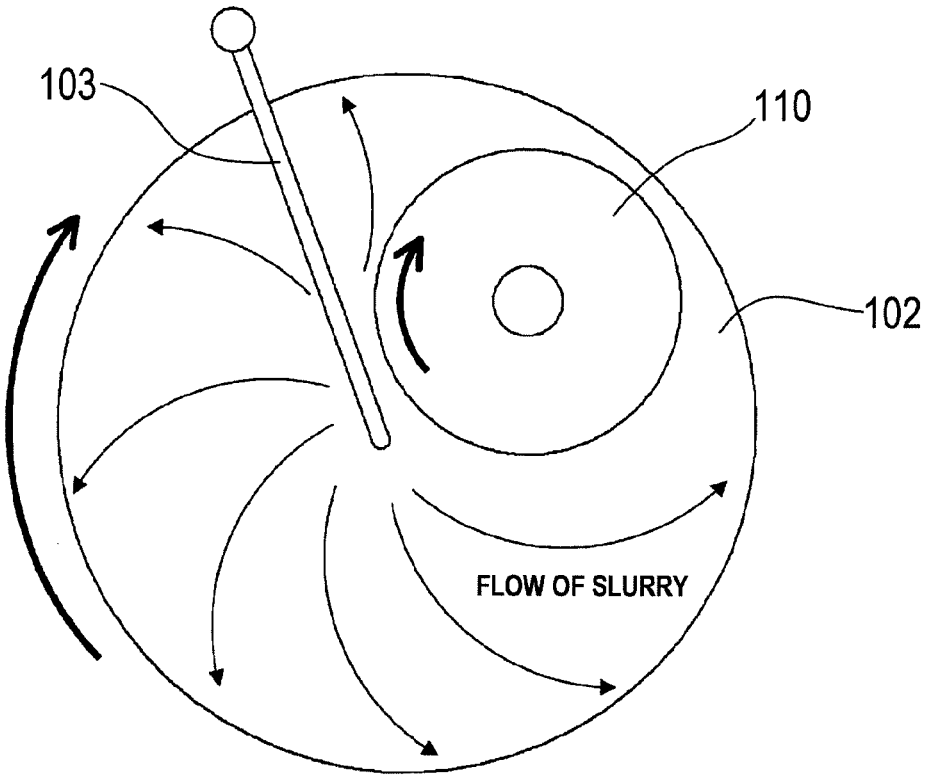
Figure 20C:
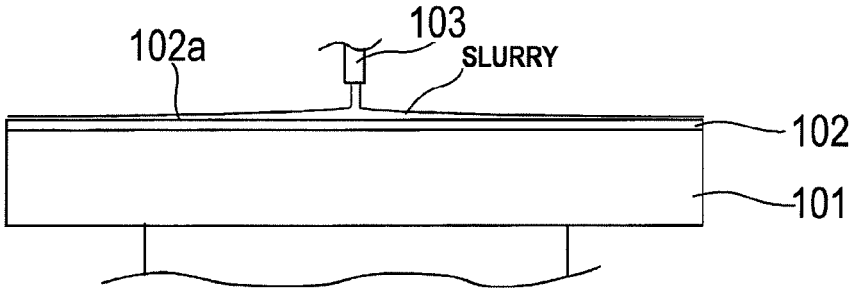

FIGS. 20A, 20B and 20C are views showing flows of the polishing liquid (slurry) which has been dropped from the polishing liquid supply nozzle 103 onto the polishing pad 102, and FIG. 20A is a perspective view, FIG. 20B is a plan view and FIG. 20C is an elevational view.

As shown in FIG. 20A, the polishing liquid (slurry) is dropped from the forward end of the polishing liquid supply nozzle 103 onto the central part of the polishing pad 102. This dropping position is near the top ring 110. As shown in FIG. 20B, the polishing liquid (slurry) dropped on the polishing pad 102 spreads evenly toward the outer circumferential side of the polishing pad 102 by centrifugal force caused by rotation of the polishing table 101. Then, as shown in FIG. 20C, the polishing liquid spreads at a substantially uniform thickness over the entire polishing surface 102*a* of the polishing pad 102 and flows in under the top ring 110. As a result, the polishing liquid (slurry) is distributed uniformly over the entire surface to be polished of the substrate W held by the top ring 110.

Figure 21A:
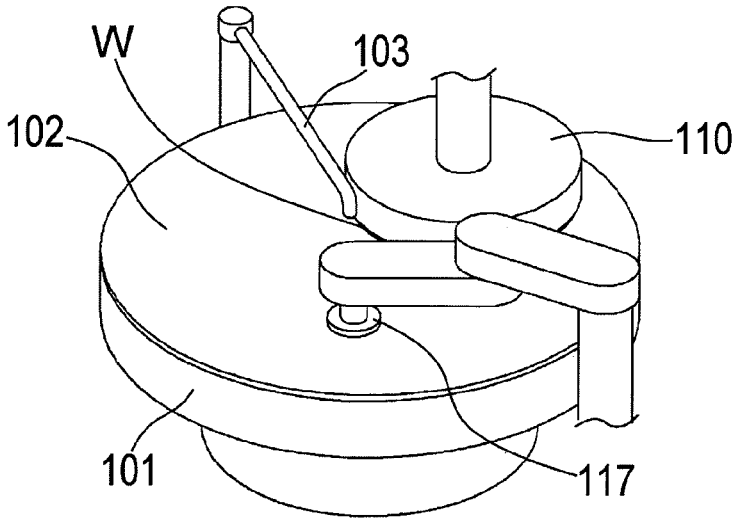
FIGS. 21A, 21B and 21C are views showing flows of the polishing liquid (slurry) which has been dropped from the polishing liquid supply nozzle onto the polishing pad in the case where both of the top ring and the dresser are operated.
Figure 21B:
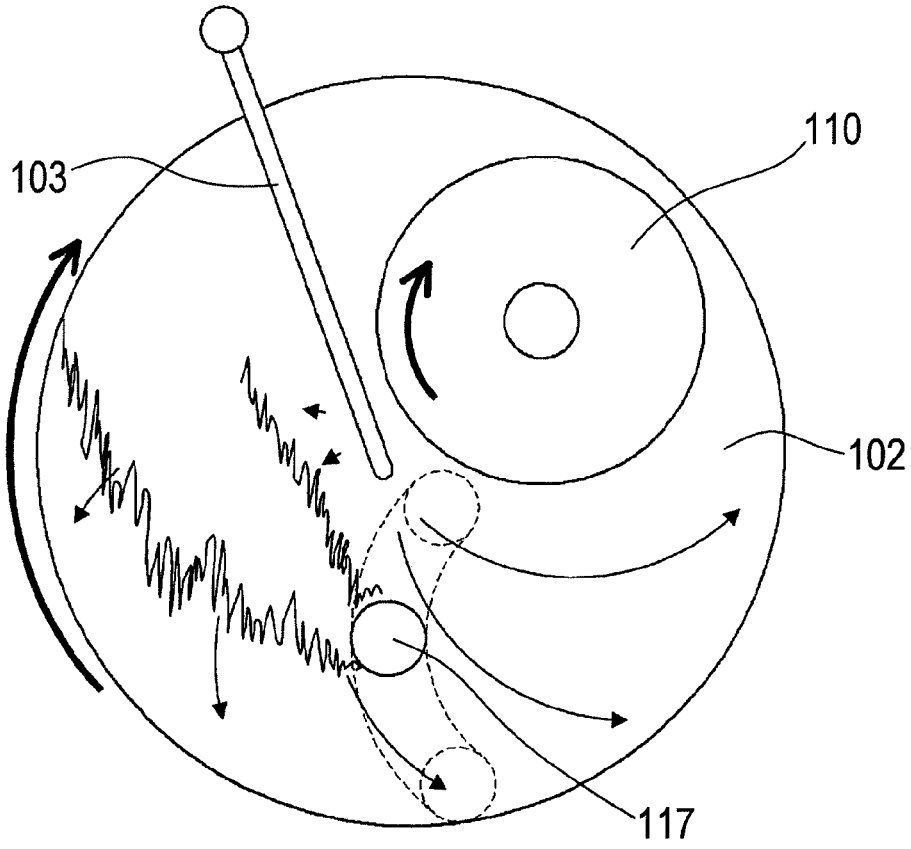
Figure 21C:
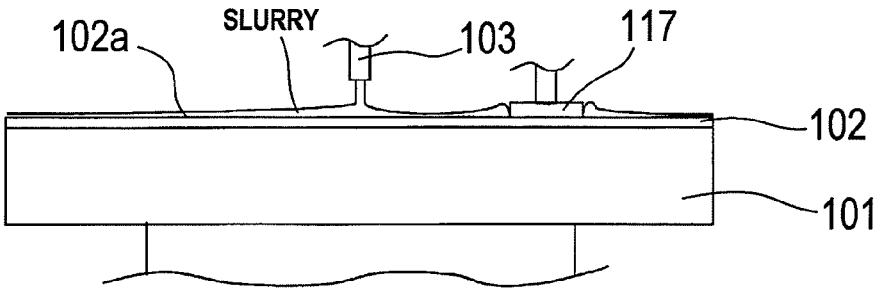

FIGS. 21A, 21B and 21C are views showing flows of the polishing liquid (slurry) which has been dropped from the polishing liquid supply nozzle 103 onto the polishing pad 102 in the case where both of the top ring 110 and the dresser 117 are operated, and FIG. 21A is a perspective view, FIG. 21B is a plan view and FIG. 21C is an elevational view.

As shown in FIG. 21A, the polishing liquid (slurry) is dropped from the forward end of the polishing liquid supply nozzle 103 onto the central part of the polishing pad 102. This dropping position is near the top ring 110. As shown in FIGS. 21B and 21C, the polishing liquid (slurry) dropped on the polishing pad 102 spreads toward the outer circumferential side of the polishing pad 102 by centrifugal force caused by rotation of the polishing table 101. However, if a dressing process by the dresser 117 is conducted during polishing, the flow of the polishing liquid (slurry) is interrupted, and thus the polishing liquid (slurry) flows in under the top ring 110 with the slurry film thickness disturbed.

Accordingly, the amount of the polishing liquid (slurry) becomes excess or deficiency depending on the areas of the surface, being polished, of the substrate W, resulting in unstable polishing state.

Therefore, according to the present invention, the flow of the polishing liquid (slurry) is controlled by the gas ejection nozzles 124 and the gas direction adjustment plates 136 in the pad temperature control mechanism 122.

Figure 22A:
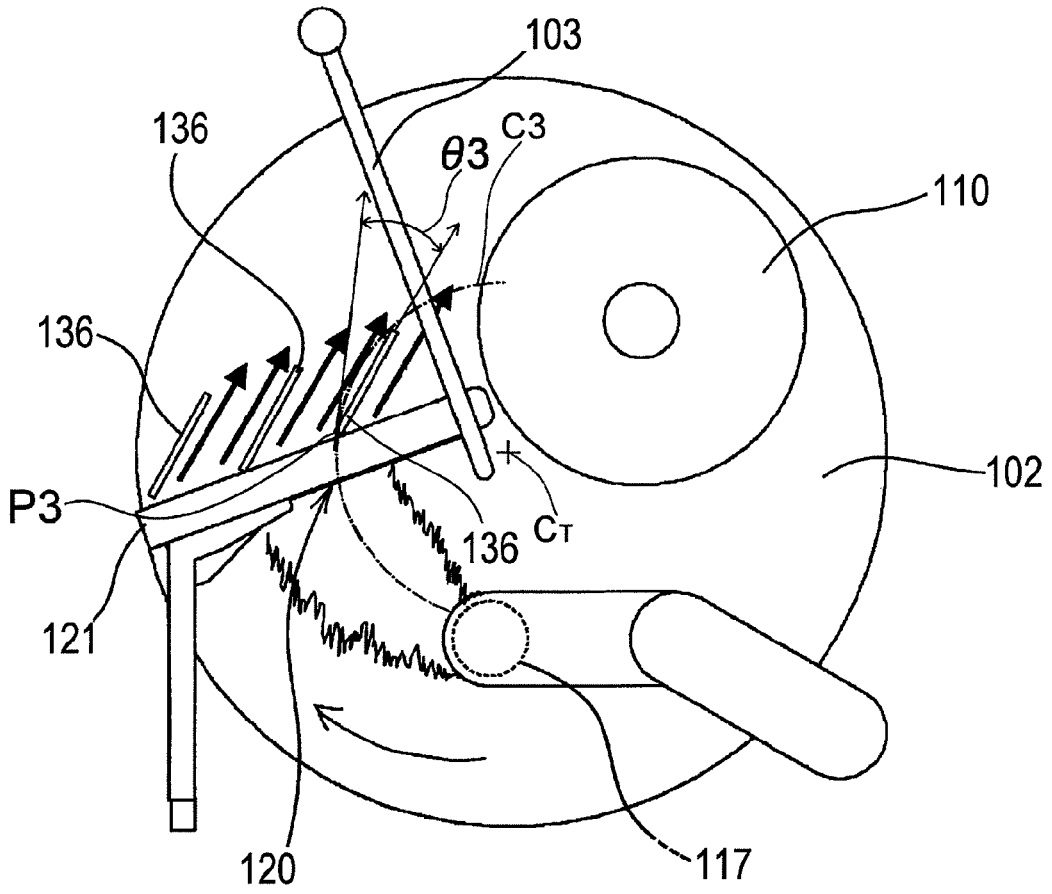
FIGS. 22A, 22B and 22C are schematic views showing a method of controlling flows of the polishing liquid (slurry) by the gas ejection nozzles and the gas direction adjustment plates in the pad temperature control mechanism.
Figure 22B:
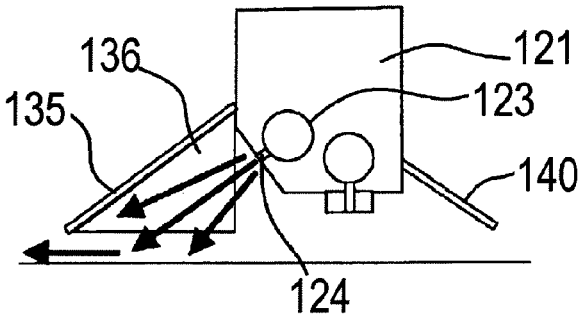
Figure 22C:
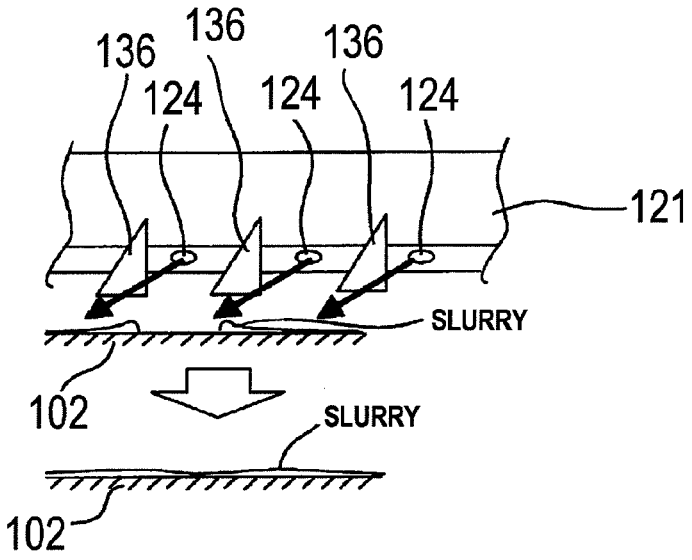

FIGS. 22A, 22B and 22C are schematic views showing a method of controlling flows of the polishing liquid (slurry) by the gas ejection nozzles 124 and the gas direction adjustment plates 136 in the pad temperature control mechanism 122, and FIG. 20A is a plan view, FIG. 20B is an elevational view and FIG. 20C is a side view.

As shown in FIG. 22A, the polishing liquid dropped on the polishing pad 102 spreads toward the outer circumferential side of the polishing pad 102 by centrifugal force caused by rotation of the polishing table 101. However, if a dressing process by the dresser 117 is conducted during polishing, the flow of the polishing liquid (slurry) is interrupted, and thus the slurry film thickness becomes in a disturbed state. Therefore, as shown in FIGS. 22A and 22B, the flow direction of air (compressed air) ejected from the gas ejection nozzles 124 is controlled by the gas direction adjustment plates 136 at the downstream side of the dresser 117 in a rotational direction of the polishing table 101.

Next, the gas direction adjustment plate 136 located at the innermost side of the polishing pad 102 will be described as an example with reference to FIG. 22A. In the case where a concentric circle C3 which passes through a point P3 located immediately below the base end of the gas direction adjustment plate 136 and is centered around the rotation center $C_T$ of the polishing pad 102 is assumed, and the tangential direction in the point P3 on the concentric circle C3 is defined as a tangential direction of rotation of the polishing pad, the flat plate-like gas direction adjustment plate 136 is inclined at a predetermined angle (θ3) toward the pad center side with respect to the tangential direction of rotation of the polishing pad. In FIG. 22A, other concentric circles are not shown to simplify the drawing. In the case where this angle (θ3) is defined as a gas guide angle, this gas guide angle (θ3) is adjusted preferably in the range of 15 to 45 degrees during polishing. The same holds true in the gas guide angle (θ3) of other gas direction adjustment plates 136.

FIG. 22C is a view showing the state in which control of the flow direction of air (compressed air) by the gas direction adjustment plates 136 can exert an influence on the flow of the slurry. In the upper side of FIG. 22C, the slurry film thickness on the polishing pad 102 is in a disturbed state. However, by controlling the flow of the air by the gas direction adjustment plates 136, as shown in the lower side of FIG. 22C, the slurry film thickness becomes gentle, i.e., becomes substantially uniform. In this manner, according to the present invention, by adjusting the gas guide angle (θ3) of the gas direction adjustment plate 136, turbulance of the polishing liquid (slurry) on the polishing pad 102 can be reduced, and thus the film thickness of the polishing liquid can be substantially uniformized.

In the example shown in FIGS. 22A, 22B and 22C, a plurality of gas direction adjustment plates 136 are directed toward the same direction. However, a plurality of gas direction adjustment plates 136 may be directed toward different directions to give a favorable change to the slurry film thickness.

Figure 23A:
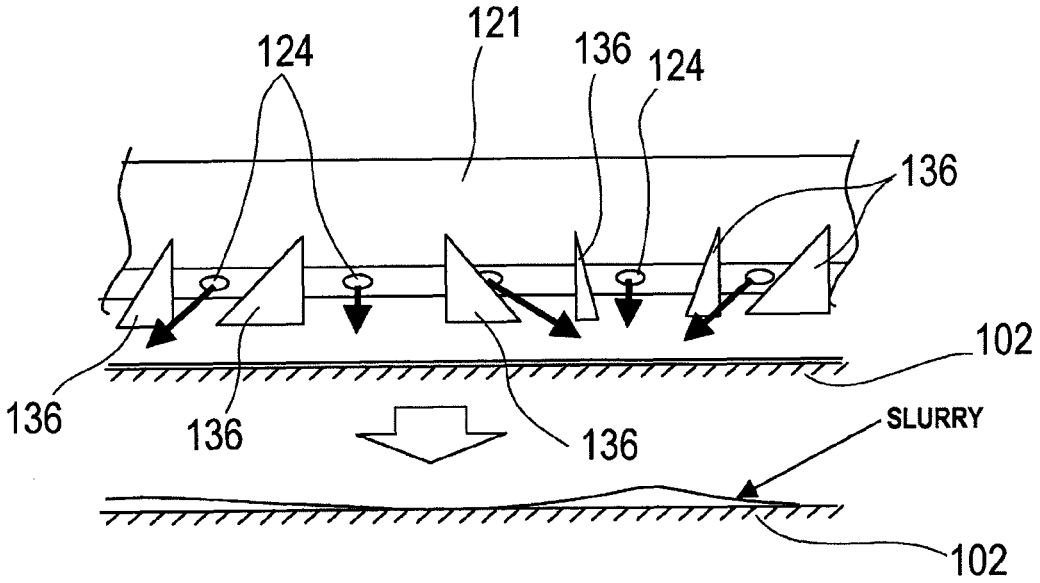
FIGS. 23A and 23B are views showing the case where a plurality of gas direction adjustment plates are directed toward different directions.
Figure 23B:
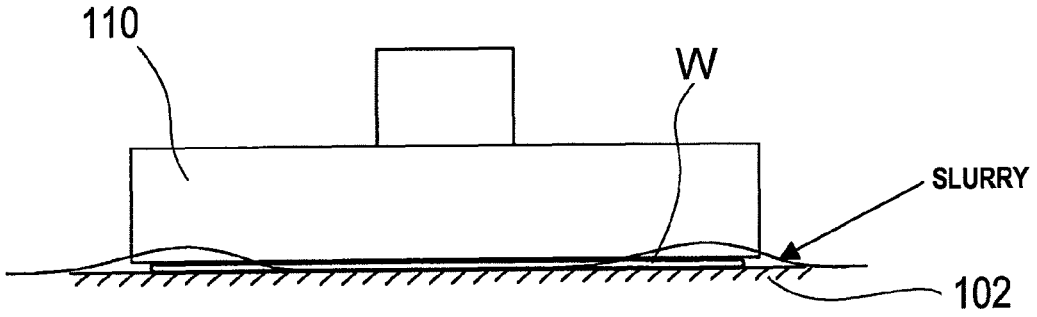

FIGS. 23A and 23B are views showing the case where a plurality of gas direction adjustment plates 136 are directed toward different directions. FIG. 23A is a schematic view showing the relationship between the directions of the gas direction adjustment plates 136 and the slurry film thickness, and FIG. 23B is a schematic view showing the relationship between the polishing liquid (slurry) on the polishing pad 102 and the substrate W held by the top ring 110.

As shown in FIG. 23A, by directing a plurality of gas direction adjustment plates 136 toward different directions, air (compressed air) ejected from the gas ejection nozzles 124 can be controlled so as to flow in different directions. Therefore, in the upper side of FIG. 23A, the slurry film thickness on the polishing pad 102 is uniform, but, as shown in the lower side of FIG. 23A, the slurry film thickness on the polishing pad 102 can be changed. In this manner, by varying the slurry film thickness, as shown in FIG. 23B, the thin part of the slurry film thickness is enabled to correspond to the central part of the substrate W and the thick part of the slurry film thickness is enabled to correspond to the outer circumferential portion of the substrate W. Thus, the polishing rate at the outer circumferential portion of the substrate can be higher than the polishing rate at the central portion of the substrate. Further, conversely, the thin part of the slurry film thickness is enabled to correspond to the outer circumferential portion of the substrate W and the thick part of the slurry film thickness is enabled to correspond to the central portion of the substrate W. Thus, the polishing rate at the central portion of the substrate can be higher than the polishing rate at the outer circumferential portion of the substrate.

As described above, according to the present invention, by adjusting the gas guide angles (θ3) of the gas direction adjustment plates 136 individually, the slurry is enabled to flow more (or less) to the edge or the central area of the substrate, and hence the polishing rate, in-plane uniformity, and the like can be controlled.

Figure 24A:
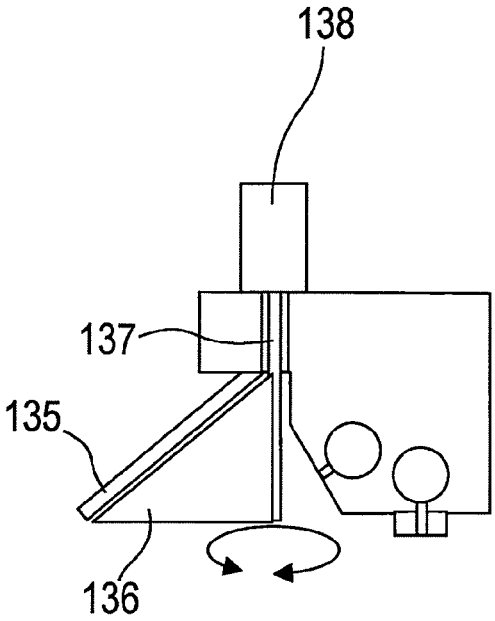
FIGS. 24A, 24B and 24C are views showing mechanisms for adjusting the directions of the gas direction adjustment plates.
Figure 24B:
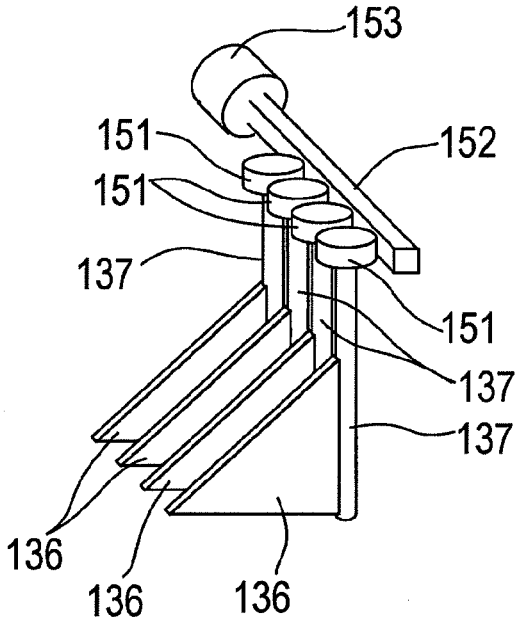
Figure 24C:
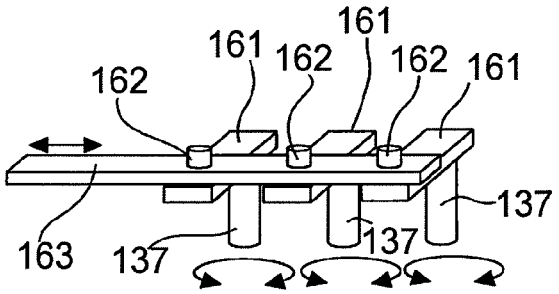

FIGS. 24A, 24B and 24C are views showing mechanisms for adjusting the directions of the gas direction adjustment plates 136. FIG. 24A is a schematic view showing a mechanism for controlling gas guide angles (θ3) of a plurality of gas direction adjustment plates 136 independently, and FIGS. 24B and 24C are schematic views showing mechanisms for controlling gas guide angles (θ3) of a plurality of gas direction adjustment plates 136 in conjunction with one another.

In the example shown in FIG. 24A, one side of a triangle-shaped gas direction adjustment plate 136 is fixed to a shaft 137, and the upper end of the shaft 137 is coupled to a servomotor or a rotary actuator 138. With this arrangement, when the servomotor or the rotary actuator 138 is operated, the gas direction adjustment plate 136 is swung about the shaft 137 to change the gas guide angle (θ3) of the gas direction adjustment plate 136. In the example shown in FIG. 24A, a plurality of gas direction adjustment plates 136 are configured to be controlled by the servomotors or the rotary actuators 138 individually. In place of the servomotor or the rotary actuator, each of the shafts 137 may be rotated manually and then fixed by a screw.

In the example shown in FIG. 24B, a plurality of gas direction adjustment plates 136 are fixed to shafts 137, respectively, and pinions 151 are fixed to upper ends of the shafts 137, respectively. Then, the pinions 141 are engaged with a single rack 152, and the rack 152 is coupled to a cylinder, a linear motor or a linear actuator 153. With this arrangement, when the cylinder, the linear motor or the linear actuator 153 is operated, the rack 152 moves forward or backward to rotate the pinions 151, and thus the gas direction adjustment plates 136 are swung about the shafts 137 to change the gas guide angles (θ3) of the gas direction adjustment plates 136. In the example shown in FIG. 24B, a plurality of gas direction adjustment plates 136 are configured to be controlled by a cylinder, a linear motor or a linear actuator 153 in conjunction with one another. In place of the cylinder, the linear motor or the rotary actuator, the rack 152 may be operated manually and then fixed by a screw.

In the example shown in FIG. 24C, illustration of the gas direction adjustment plates 136 is omitted, and only a mechanism for driving a plurality of shafts 137 is illustrated. As shown in FIG. 24C, a plurality of shafts 137 are coupled to one ends of arms 161, respectively. The other ends of the arms 161 are coupled to a link 163 through connecting pins 162. Each of the shafts 137 is supported by a bearing or the like so that the shaft 137 is prevented from moving in its axial direction and is allowed only to be rotated. With this arrangement, when linear reciprocating motion of the link 163 is made by the cylinder, the linear motor, the actuator (not shown) or the like, the plural arms 161 are swung about the respective shafts 137, and thus the end portion sides of the arms 161 serving as portions for fixing the shafts 137 are rotated. Therefore, the shafts 137 rotate about their own axes, and hence the gas guide angles (θ3) of the gas direction adjustment plates 136 can be changed.

Figure 25:
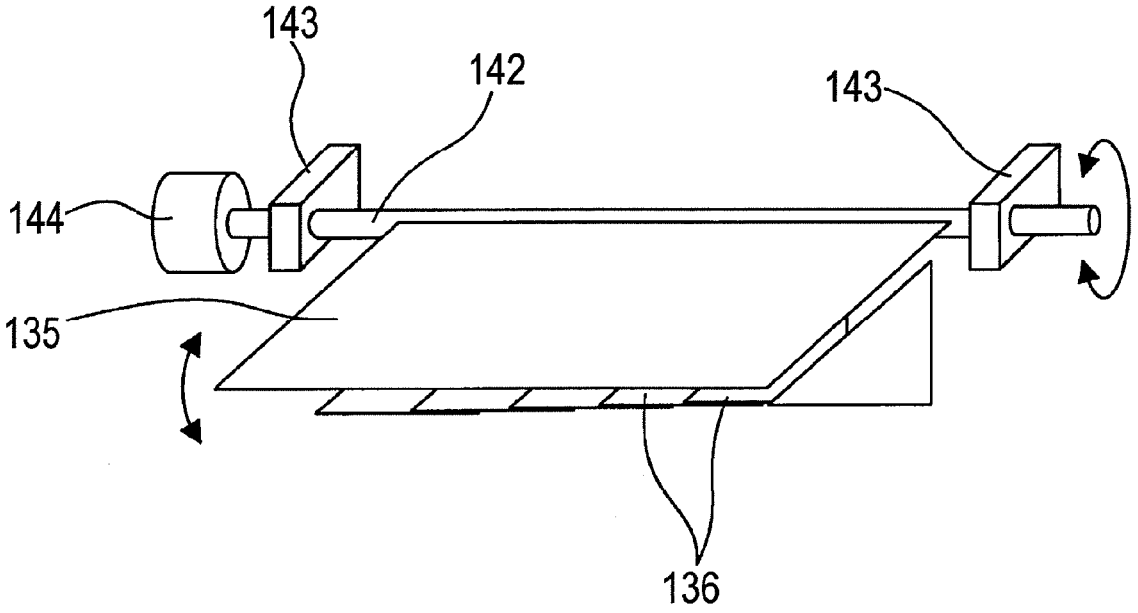
FIG. 25 is a schematic view showing an example in which an angle of the gas ejection nozzle cover can be adjusted.

FIG. 25 is a schematic view showing an example in which an angle of the gas ejection nozzle cover 135 can be adjusted. Although the gas ejection nozzle cover 135 is fixed to the main body portion 121 in the example shown in FIGS. 12 through 14, the end portion of the gas ejection nozzle cover 135 is fixed to a shaft 142 in the example shown in FIG. 25. The shaft 142 is rotatably supported by two brackets 143, 143 extending from the main body portion 121 (not shown) of the pad adjustment apparatus 120. Further, the end portion of the shaft 142 is coupled to a servomotor or a rotary actuator 144. With this arrangement, when the servomotor or the rotary actuator 144 is operated, the gas ejection nozzle cover 135 is swung about the shaft 142, and thus an inclination of the gas ejection nozzle cover 135 in a vertical direction can be changed. Therefore, the inclination of the gas ejection nozzle cover 135 can be adjusted at an optimum angle in accordance with the gas approach angle (θ2) between the surface (polishing surface) 102*a* of the polishing pad 102 and the gas ejection direction of the gas ejection nozzle 124 (see FIG. 18).

For example, when the gas ejection nozzles 124 are fixed and the gas ejection direction cannot be changed or when the gas is supplied at a fixed flow rate, by moving the gas ejection nozzle cover 135, the amount of gas directed toward the surface 102*a* of the polishing pad 102 can be changed to vary the intensity of cooling. Further, the gas ejection nozzle cover 135 is opened to lose the function of the gas ejection nozzle cover 135 for guiding the gas so that the gas does not flow toward the surface 102*a* of the polishing pad 102. In this case, the slurry can be flowed toward the top ring 110 with the slurry film thickness changed by the gas direction adjustment plates 136.

The structure of the gas direction adjustment plates 136 within the gas ejection nozzle cover 135 is the same as that shown in FIGS. 12 through 15.

Next, a method of controlling the amount of slurry to be consumed by controlling the flow of the polishing liquid (slurry) on the polishing pad 102 by the gas direction adjustment plates 136 for controlling the flow direction of air (compressed air) ejected from the gas ejection nozzles 124 of the pad temperature control mechanism 122.

Figure 26:
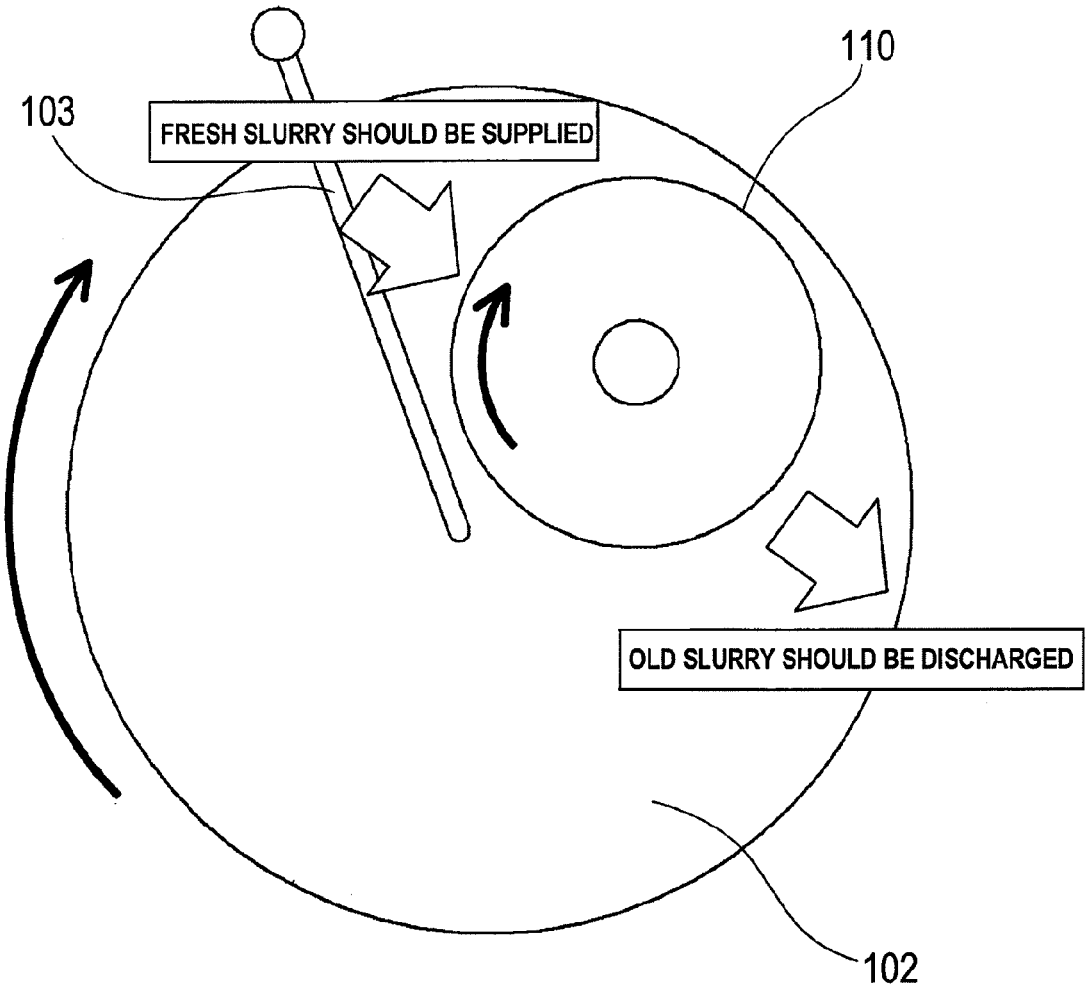
FIG. 26 is a schematic plan view showing the state in which the polishing liquid (slurry) dropped from the polishing liquid supply nozzle onto the polishing pad flows in under the top ring and is then discharged from the polishing pad.

FIG. 26 is a schematic plan view showing the state in which the polishing liquid (slurry) dropped from the polishing liquid supply nozzle 103 onto the polishing pad 102 flows in under the top ring 110 and is then discharged from the polishing pad 102. In this case, it is preferable that fresh slurry dropped on the polishing pad 102 is supplied as much as possible to the surface, being polished, of the substrate held by the top ring 110, and old slurry which has been used for polishing is discharged as quickly as possible. This is because if the fresh slurry is discharged without being used for polishing, the consumed amount of slurry increases, and if the old slurry remains on the polishing pad, the polishing rate and the in-plane uniformity are adversely affected.

Figure 27:
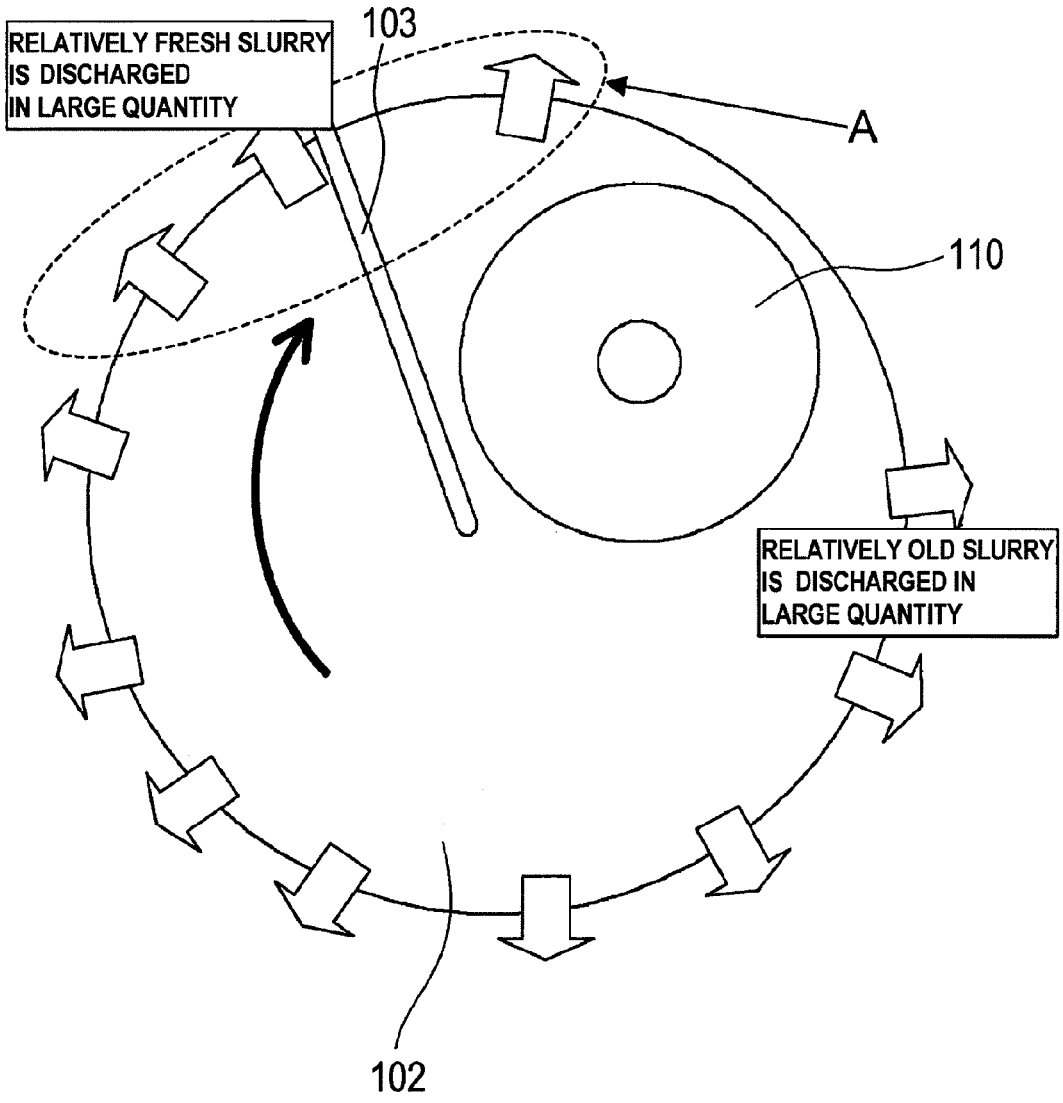
FIG. 27 is a schematic view showing the flow of the fresh slurry dropped on the polishing pad and the flow of the used slurry.

FIG. 27 is a schematic view showing the flow of the fresh slurry dropped on the polishing pad 102 and the flow of the used slurry. As shown in FIG. 27, the slurry is discharged from the outer circumferential portion of the polishing pad 102, and relatively fresh slurry is discharged in large quantity at an immediately upstream side of the top ring 110 in a rotational direction of the polishing table 101 and relatively old slurry is discharged in large quantity at an immediately downstream side of the top ring 110 in a rotational direction of the polishing table 101. Therefore, if the slurry discharged from an area A shown by a dotted line in FIG. 27 can be used for polishing, the consumed amount of slurry can be reduced.

Therefore, according to the present invention, the flow of slurry is controlled by the gas ejection nozzles 124 and the gas direction adjustment plates 136 so that the slurry discharged from the area A is eliminated or minimized.

Figure 28:
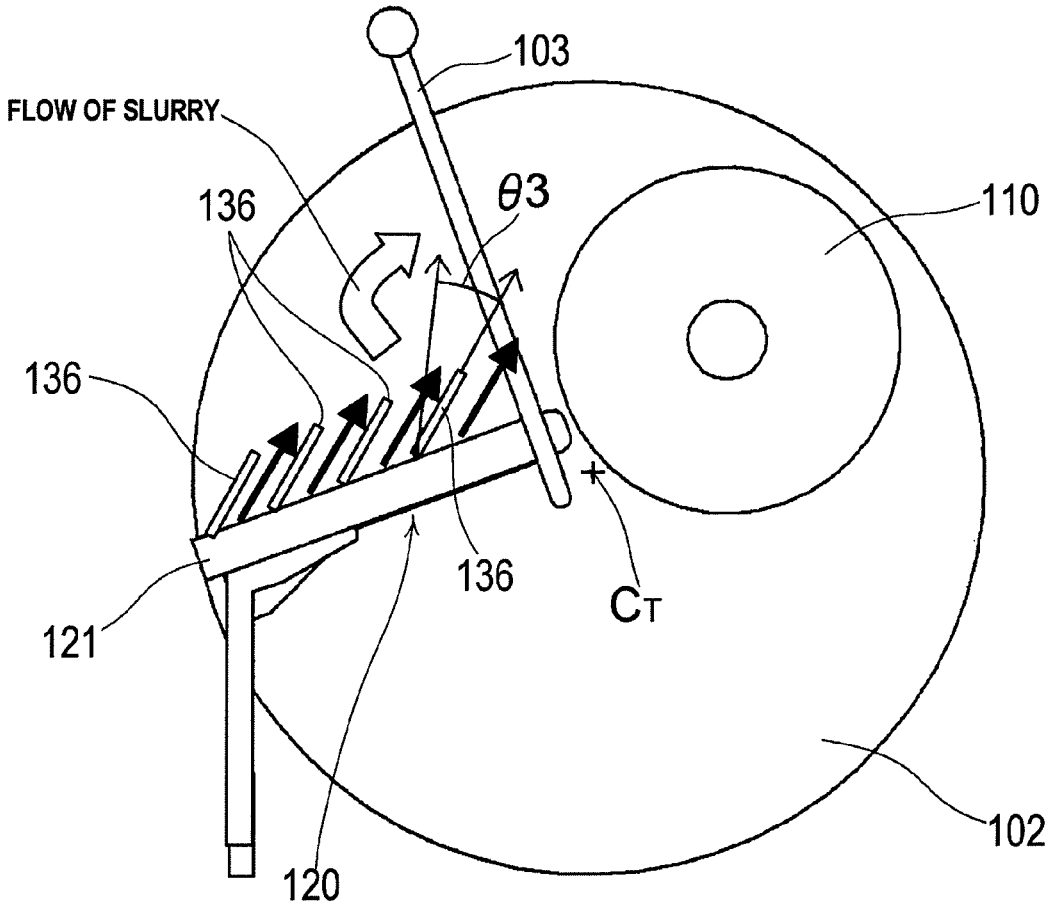
FIG. 28 is a schematic plan view showing a method of controlling the flow of slurry by the gas ejection nozzles and the gas direction adjustment plates.

FIG. 28 is a schematic plan view showing a method of controlling the flow of slurry by the gas ejection nozzles 124 and the gas direction adjustment plates 136. As shown in FIG. 28, by adjusting the gas guide angle (θ3) which is an angle of the gas direction adjustment plate 136 with respect to the tangential direction of rotation of the polishing pad, the flow direction of air (compressed air) ejected from the gas ejection nozzles 124 is directed inwardly of the polishing table 101, and the slurry flowing toward the outer circumferential side of the polishing pad 102 is controlled so as to flow toward the central side of the polishing pad 102, thereby allowing the slurry to remain on the polishing pad 102. Thus, the slurry discharged from the area A can be eliminated or minimized.

Figure 29:
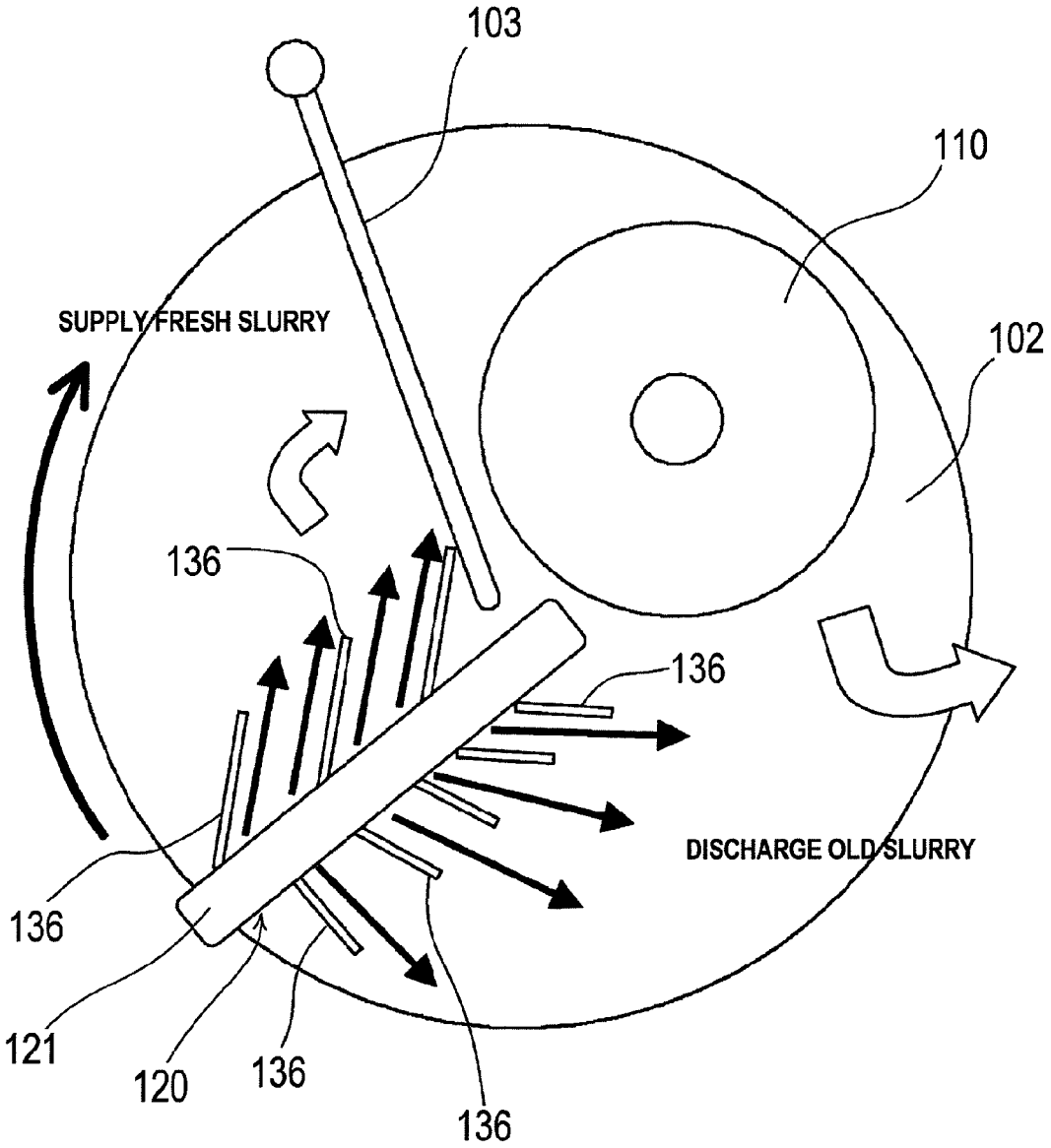
FIG. 29 is a schematic plan view showing an example in which the gas ejection nozzles and the gas direction adjustment plates are provided on the other side of the main body portion to promote discharge of the old slurry which has been used for polishing.

FIG. 29 is a schematic plan view showing an example in which the gas ejection nozzles 124 and the gas direction adjustment plates 136 are provided on the other side of the main body portion 121 to promote discharge of the old slurry which has been used for polishing. As shown in FIG. 29, the gas ejection nozzles 124 and the gas direction adjustment plates 136 are provided on both sides of the man body portion 121, and air is ejected from the gas ejection nozzles 124 provided on both sides of the main body portion 121 and the flow of air is controlled by the gas direction adjustment plates 136 provided on both sides of the main body portion 121. Specifically, the gas ejection nozzles 124 and the gas direction adjustment plates 136 located at the upstream side in the rotational direction of the polishing table 101 are configured to eject air (compressed air) on the opposite side (facing side) of the rotational direction of the polishing table 101 and to control the flow of air. Thus, the flow direction of air is directed toward the outer circumferential side of the polishing table 101 to promote discharge of the old slurry. Specifically, the old slurry which has been used for polishing and is located at the downstream side of the top ring 110 in the rotational direction of the polishing table 101 is discharged by air and centrifugal force.

On the other hand, the gas ejection nozzles 124 and the gas direction adjustment plates 136 located at the downstream side in the rotational direction of the polishing table 101 are configured to eject air in the rotational direction of the polishing table 101 and to control the flow of air. By adjusting the gas guide angle (θ3) of the gas direction adjustment plate 136, the flow direction of air is directed inwardly of the polishing table 101, and the slurry flowing toward the outer circumferential side of the polishing pad 102 is controlled so as to flow toward the central side of the polishing pad 102, thereby allowing the slurry to remain on the polishing pad 102. As a result, the slurry discharged from the area A shown in FIG. 27 can be eliminated or minimized. In this manner, the flow direction of cooling air ejected from the gas ejection nozzles 124 is adjusted to discharge the old slurry quickly and to prevent the fresh slurry at the supply side from flowing down from the polishing pad 102, thereby reducing the consumed amount of slurry tremendously.

Although the case where the flow of the polishing liquid (slurry) on the polishing pad 102 is controlled by air (compressed air) has been mainly described in the embodiments shown in FIGS. 20 through 29, control of temperature of the polishing surface 102*a* of the polishing pad 102 at a desired value by the air ejected from the gas ejection nozzles 124 toward the polishing pad 102 is performed in the same manner as the embodiments shown in FIGS. 10 through 19.

Next, an example of processes of polishing the substrate W using a polishing apparatus constructed as shown in FIGS. 10 through 29 will be described in detail.

First, a first preset temperature as a control target temperature of the polishing pad 102 is set in the temperature controller 147. Then, a supply pressure for supplying compressed air to the gas ejection nozzles 124 is confirmed. When this supply pressure is not more than a predetermined pressure, an alarm is issued and the subsequent process of the substrate is stopped. Only when the supply pressure is not less than the predetermined pressure, the top ring 110 located at the substrate transfer position receives the substrate W from the pusher or the like and holds the substrate W under vacuum. Then, the substrate W held under vacuum by the top ring 110 is moved horizontally from the substrate transfer position to the polishing position immediately above the polishing table 101.

Next, temperature monitoring of the polishing pad 102 by the radiation thermometer 148 is started. Then, the polishing liquid (slurry) is dropped from the polishing liquid supply nozzle 103 onto the polishing pad 102, and the top ring 110 is lowered while the top ring 110 is rotated to bring the surface (the surface to be polished) of the substrate W into contact with the polishing surface 102*a* of the rotating polishing pad 102. Then, attraction of the substrate W by the top ring 110 is released, and the substrate W is pressed against the polishing surface 102*a* under a first polishing pressure. Thus, a main polishing step for polishing a metal film or the like on the substrate is started.

In the main polishing step, temperature control of the polishing pad 102 by the pad temperature control mechanism 122 of the pad adjustment apparatus 120 is started at the time when the substrate W is brought into contact with the polishing surface 102*a*. If the process in which the substrate W is brought into contact with the polishing surface 102*a* without rotating the polishing table 1 is employed, temperature control of the polishing pad 102 by the pad temperature control mechanism 122 is started at the same time when rotation of the polishing table 101 is started.

Specifically, the temperature controller 147 controls the ratio of valve opening of the pressure regulating valve 146 based on the PID control according to the difference between the first preset temperature which has been preset and actual temperature of the polishing pad 102 detected by the radiation thermometer 148 to control a flow rate of compressed air ejected from the gas ejection nozzles 124. Thus, the temperature of the polishing pad 102 is control led at the first preset temperature for obtaining the maximum polishing rate which has been determined in advance. In this main polishing step, high polishing rate can be obtained by a combination of the high polishing pressure and cooling of the polishing pad 102, and hence the total polishing time can be shortened.

Further, in parallel with the above process, the polishing liquid (slurry) is supplied to the optimum position on the polishing pad 102 by swinging the polishing liquid supply nozzle 103 and the flow of air ejected from the gas ejection nozzles 124 is controlled by the gas direction adjustment plates 136. Thus, the flow of the polishing liquid (slurry) on the polishing pad 102 is controlled so as to uniformize the film thickness of slurry flowing toward the top ring 110, thereby obtaining in-plane uniformity. This main polishing step is terminated, for example, when a film thickness measuring instrument (not shown) provided in the polishing table 101 detects the state in which a thickness of a film such as a metal film reaches a predetermined value.

Next, a finish polishing step is performed. In the finish polishing step after the main polishing step, in order to place importance on improvement of the step height characteristics by preventing dishing, erosion or the like from occurring, it is necessary to control the temperature of the polishing pad 102. Specifically, a second preset temperature different from the first preset temperature is set in the temperature controller 147. After shifting to the finish polishing step, compressed air whose flow rate is controlled by the PID control so that the polishing pad 102 reaches the second preset temperature quickly is blown onto the polishing pad 102. For example, in the case where the second preset temperature in the finish polishing step is lower than the first preset temperature in the main polishing step, the flow rate of the compressed air is controlled at the maximum until the polishing pad 102 reaches the second preset temperature. In this manner, the temperature of the polishing pad 102 is controlled at the second preset temperature, and polishing is continued. In the finish polishing step, in order to improve the step height resolution characteristics mainly, the substrate W is pressed against the polishing surface 102*a* under the second polishing pressure which is lower than the first polishing pressure. Further, in parallel with the above process, the polishing liquid (slurry) is supplied to the optimum position on the polishing pad 102 by swinging the polishing liquid supply nozzle 103, and the gas ejection nozzles 124 and the gas direction adjustment plates 136 are organically operated. Thus, the slurry is flowed more (or less) to the edge or the central area of the substrate to control the polishing rate, the in-plane uniformity and the like. This finish polishing step is terminated, for example, when the film thickness measuring instrument (not shown) provided in the polishing table 101 detects the state in which a surplus metal film or the like located at areas other than trench or the like is polished and removed to expose a surface of an underlayer completely.

Next, ejection of the compressed air from the gas ejection nozzles 124 is stopped and supply of the polishing liquid (slurry) from the polishing liquid supply nozzle 103 is stopped, and then pure water (deionized water) is supplied onto the polishing pad 102 to conduct water polishing of the substrate W. Then, ejection of the compressed air from the gas ejection nozzles 124 is stopped, and the polished substrate W is detached from the polishing surface 102*a* and held under vacuum by the top ring 110 while the compressed air is prevented from blowing against the substrate W. After that, the substrate W moves away from the polishing pad 102, and hence ejection of the compressed air from the gas ejection nozzles 124 remains at rest in order to prevent the polished surface of the substrate W from being dried due to blowing of the compressed air against the polished surface of the substrate W.

Next, the top ring 110 which holds the substrate W under vacuum is lifted, and the substrate W is moved horizontally from the polishing position to the substrate transfer position. Then, the polished substrate W is transferred at the substrate transfer position to the pusher or the like. After polishing is finished, pure water (or mixed fluid of nitrogen and pure water) is blown on the surface (polishing surface) 102*a* of the polishing pad 102 from the nozzles 133 of the atomizer 130 to remove foreign matters (polishing pad chips, polishing liquid fixation, and the like) on the polishing pad. In the gas ejection nozzles 124, a cleaning liquid (water) is blown from cleaning nozzles (not shown) onto nozzle opening portions and their surrounding areas, thereby conducting cleaning of the gas ejection nozzles 124. Thus, dirt such as slurry attached to the gas ejection nozzles 124 can be prevented from falling onto the polishing pad 102 to avoid an adverse effect on the processing of the subsequent substrate. Further, the gas ejection nozzle cover 135 and the gas direction adjustment plates 136 are cleaned in the same manner as the above. In this case, because the gas ejection nozzle cover 135 and the gas direction adjustment plates 136 are open in their inner sides, the inner sides of the gas ejection nozzle cover 135 and the gas direction adjustment plates 136 can be cleaned at the time of using the atomizer 130.

Although the embodiments of the present invention have been described herein, the present invention is not intended to be limited to these embodiments. Therefore, it should be noted that the present invention may be applied to other various embodiments within a scope of the technical concept of the present invention.

What is claimed is:

1. A polishing method of polishing a surface of a substrate as an object to be polished by pressing the substrate against a polishing pad on a polishing table while a polishing liquid is supplied onto the polishing pad, said polishing method comprising:

ejecting a gas toward the polishing pad from at least one gas ejection nozzle; and blowing the gas onto the polishing pad by adjusting a direction of the gas ejected from said at least one gas ejection nozzle with a gas direction adjustment plate provided near said gas ejection nozzle.

2. The polishing method according to claim 1, wherein a flow of the polishing liquid on the polishing pad is controlled by adjusting the direction of the gas ejected from said gas ejection nozzle with said gas direction adjustment plate.

3. The polishing method according to claim 2, wherein said gas ejection nozzle and said gas direction adjustment plate are disposed at a downstream side of a dresser in a rotational direction of the polishing table; and a flow of the polishing liquid on the polishing pad is controlled at the downstream side of the dresser which conducts dressing during polishing.

4. The polishing method according to claim 2, wherein the polishing liquid which flows toward an outer circumferential side of the polishing pad is controlled so as to flow toward a central side of the polishing pad by adjusting a direction of the gas ejected from said gas ejection nozzle with said gas direction adjustment plate.

5. The polishing method according to claim 2, wherein old polishing liquid which has been used for polishing and is located at a downstream side of a top ring for holding the substrate in a rotational direction of the polishing table is controlled so as to flow toward an outer circumferential side of the polishing pad by adjusting a direction of the gas ejected from said gas ejection nozzle with said gas direction adjustment plate.

6. The polishing method according to claim 1, wherein a polishing liquid supply nozzle for supplying the polishing liquid onto the polishing pad is swingable, and a supply position of the polishing liquid is changed during polishing.

7. A polishing method of polishing a surface of a substrate as an object to be polished by pressing the substrate against a polishing pad on a polishing table, said polishing method comprising:

supplying a gas from a gas supply unit to at least one gas ejection nozzle; and ejecting the gas toward the polishing pad from said at least one gas ejection nozzle;

wherein a concentric circle which passes through a point located immediately below said at least one gas ejection nozzle and is centered around a rotation center of the polishing pad is assumed and a tangential direction in said point on said concentric circle is defined as a tangential direction of rotation of the polishing pad, and a gas ejection direction of said at least one gas ejection nozzle is inclined toward a rotation center side of the polishing pad with respect to said tangential direction of rotation of the polishing pad.

8. The polishing method according to claim 7, wherein a height of said at least one gas ejection nozzle from the surface of the polishing pad is adjustable.

9. The polishing method according to claim 7, wherein an angle of said gas ejection direction of said at least one gas ejection nozzle with respect to said tangential direction of rotation of the polishing pad is set in the range of 15 to 35 degrees.

10. The polishing method according to claim 7, wherein a flow rate of the gas ejected from said at least one gas ejection nozzle is controlled by a control valve and a temperature of the polishing pad is detected by a thermometer; and the flow rate of the gas ejected from said at least one gas ejection nozzle is controlled by comparing a preset temperature as a control target temperature of the polishing pad and the temperature of the polishing pad detected by said thermometer and by adjusting a ratio of valve opening of said control valve.

11. The polishing method according to claim 10, wherein the flow rate of the gas ejected from said at least one gas ejection nozzle is controlled by adjusting said ratio of valve opening of said control valve with a PID control on the basis of a difference between said preset temperature of the polishing pad and the detected temperature of the polishing pad.

12. A polishing method of polishing a surface of a substrate as an object to be polished by pressing the substrate against a polishing pad on a polishing table, said polishing method comprising:

supplying a gas from a gas supply unit to at least one gas ejection nozzle; and ejecting the gas toward the polishing pad from said at least one gas ejection nozzle;

wherein a gas ejection direction of said at least one gas ejection nozzle is not perpendicular to the surface of the polishing pad, but is inclined toward a rotational direction side of the polishing pad; and wherein said ejecting of the gas toward the polishing pad is conducted while adjusting a height of said gas ejection nozzle.

13. A polishing method of polishing a surface of a substrate as an object to be polished by pressing the substrate against a polishing pad on a polishing table, said polishing method comprising:

supplying a gas from a gas supply unit to at least one gas ejection nozzle; and ejecting the gas toward the polishing pad from said at least one gas ejection nozzle;

wherein a gas ejection direction of said at least one gas ejection nozzle is not perpendicular to a surface of the polishing pad, but is inclined toward a rotational direction side of the polishing pad; and wherein a height of said at least one gas ejection nozzle from the surface of the polishing pad is adjustable.

14. The polishing method according to claim 12, wherein an angle of said gas ejection direction of said at least one gas ejection nozzle with respect to the surface of the polishing pad is set in the range of 30 to 50 degrees.

15. A polishing method of polishing a surface of a substrate as an object to be polished by pressing the substrate against a polishing pad on a polishing table, said polishing method comprising:

supplying a gas from a gas supply unit to at least one gas ejection nozzle; and ejecting the gas toward the polishing pad from said at least one gas ejection nozzle;

wherein a gas ejection direction of said at least one gas ejection nozzle is not perpendicular to a surface of the polishing pad, but is inclined toward a rotational direction side of the polishing pad;

wherein a flow rate of the gas ejected from said at least one gas ejection nozzle is controlled by a control valve and a temperature of the polishing pad is detected by a thermometer; and wherein the flow rate of the gas ejected from said at least one gas ejection nozzle is controlled by comparing a preset temperature as a control target temperature of the polishing pad and the temperature of the polishing pad detected by said thermometer and by adjusting a ratio of valve opening of said control valve.

16. The polishing method according to claim 15, wherein the flow rate of the gas ejected from said at least one gas ejection nozzle is controlled by adjusting said ratio of valve opening of said control valve with a PID control on the basis of a difference between said preset temperature of the polishing pad and the detected temperature of the polishing pad.

17. The polishing method according to claim 7, wherein said ejecting of the gas toward the polishing pad is performed during polishing of the substrate while a polishing liquid is supplied.

18. The polishing method according to claim 7, wherein said ejecting of the gas toward the polishing pad is conducted while adjusting a height of said gas ejection nozzle.

19. The polishing method according to claim 12, wherein said ejecting of the gas toward the polishing pad is performed during polishing of the substrate while a polishing liquid is supplied.

20. A polishing method of polishing a substrate by using a polishing apparatus, said polishing method comprising:

rotating a polishing pad;

supplying a polishing liquid toward the polishing pad;

polishing the substrate while said supplying the polishing liquid; and ejecting a gas toward the polishing pad from a gas ejection nozzle while said polishing the substrate;

wherein a gas ejection direction of said gas ejection nozzle is inclined toward a rotation center side of the polishing pad with respect to a tangential direction of rotation of the polishing pad.

21. The polishing method according to claim 20, wherein a height of said gas ejection nozzle from a surface of the polishing pad is adjustable.

22. The polishing method according to claim 20, wherein an angle of said gas ejection direction of said gas ejection nozzle with respect to said tangential direction of rotation of the polishing pad is set in the range of 15 to 35 degrees.

23. The polishing method according to claim 20, wherein a flow rate of the gas ejected from said gas ejection nozzle is controlled by a control valve and a temperature of the polishing pad is detected by a thermometer; and the flow rate of the gas ejected from said gas ejection nozzle is controlled by comparing a preset temperature as a control target temperature of the polishing pad and the temperature of the polishing pad detected by said thermometer and by adjusting a ratio of valve opening of said control valve.

24. The polishing method according to claim 23, wherein the flow rate of the gas ejected from said gas ejection nozzle is controlled by adjusting said ratio of valve opening of said control valve with a PID control on the basis of a difference between said preset temperature of the polishing pad and the detected temperature of the polishing pad.

25. The polishing method according to claim 20, wherein said ejecting of the gas toward the polishing pad is conducted while adjusting a height of said gas ejection nozzle.

26. A method of a temperature control using a gas on a polishing pad to polish a substrate, said method comprising:

rotating the polishing pad;

supplying a polishing liquid while said rotating the polishing pad;

polishing the substrate while said supplying the polishing liquid; and ejecting the gas from a gas ejection nozzle while said polishing the substrate;

wherein a gas ejection direction of said gas ejection nozzle is inclined toward a rotation center side of the polishing pad with respect to a tangential direction of rotation of the polishing pad.

27. The method according to claim 26, wherein a height of said gas ejection nozzle from a surface of the polishing pad is adjustable.

28. The method according to claim 26, wherein an angle of said gas ejection direction of said gas ejection nozzle with respect to said tangential direction of rotation of the polishing pad is set in the range of 15 to 35 degrees.

29. The method according to claim 26, wherein a flow rate of the gas ejected from said gas ejection nozzle is controlled by a control valve and a temperature of the polishing pad is detected by a thermometer; and the flow rate of the gas ejected from said gas ejection nozzle is controlled by comparing a preset temperature as a control target temperature of the polishing pad and the temperature of the polishing pad detected by said thermometer and by adjusting a ratio of valve opening of said control valve.

30. The method according to claim 29, wherein the flow rate of the gas ejected from said gas ejection nozzle is controlled by adjusting said ratio of valve opening of said control valve with a PID control on the basis of a difference between said preset temperature of the polishing pad and the detected temperature of the polishing pad.

31. The method according to claim 26, wherein said ejecting of the gas toward the polishing pad is conducted while adjusting a height of said gas ejection nozzle.

32. A polishing method of polishing a substrate by using a polishing apparatus, said polishing method comprising:

rotating a polishing pad;

polishing the substrate using a slurry; and ejecting a gas from a gas ejection nozzle during said polishing the substrate;

wherein a gas ejection direction of said gas ejection nozzle is inclined toward a rotation center side of the polishing pad with respect to a tangential direction of rotation of the polishing pad.

33. The polishing method according to claim 32, wherein a height of said gas ejection nozzle from a surface of the polishing pad is adjustable.

34. The polishing method according to claim 32, wherein an angle of said gas ejection direction of said gas ejection nozzle with respect to said tangential direction of rotation of the polishing pad is set in the range of 15 to 35 degrees.

35. The polishing method according to claim 32, wherein a flow rate of the gas ejected from said gas ejection nozzle is controlled by a control valve and a temperature of the polishing pad is detected by a thermometer; and the flow rate of the gas ejected from said gas ejection nozzle is controlled by comparing a preset temperature as a control target temperature of the polishing pad and the temperature of the polishing pad detected by said thermometer and by adjusting a ratio of valve opening of said control valve.

36. The polishing method according to claim 35, wherein the flow rate of the gas ejected from said gas ejection nozzle is controlled by adjusting said ratio of valve opening of said control valve with a PID control on the basis of a difference between said preset temperature of the polishing pad and the detected temperature of the polishing pad.

37. The polishing method according to claim 32, wherein said ejecting of the gas toward the polishing pad is conducted while adjusting a height of said gas ejection nozzle.

38. A polishing method of polishing a substrate by using a polishing apparatus, said polishing method comprising:

rotating a polishing pad on a polishing table;

supplying a polishing liquid to a central part of the polishing pad;

ejecting a gas from a plurality of gas ejection nozzles which are arranged along a radial direction of the polishing pad;

polishing the substrate on the polishing pad;

wherein a gas ejection direction of said plurality of gas ejection nozzles is inclined toward a rotation center side of the polishing pad with respect to a tangential direction of rotation of the polishing pad.

39. The polishing method according to claim 38, wherein a height of said plurality of gas ejection nozzles from a surface of the polishing pad is adjustable.

40. The polishing method according to claim 38 wherein an angle of said gas ejection direction of said plurality of gas ejection nozzles with respect to said tangential direction of rotation of the polishing pad is set in the range of 15 to 35 degrees.

41. The polishing method according to claim 38, wherein a flow rate of the gas ejected from said plurality of gas ejection nozzles is controlled by a control valve and a temperature of the polishing pad is detected by a thermometer; and the flow rate of the gas ejected from said plurality of gas ejection nozzles is controlled by comparing a preset temperature as a control target temperature of the polishing pad and the temperature of the polishing pad detected by said thermometer and by adjusting a ratio of valve opening of said control valve.

42. The polishing method according to claim 41, wherein the flow rate of the gas ejected from said plurality of gas ejection nozzles is controlled by adjusting said ratio of valve opening of said control valve with a PID control on the basis of a difference between said preset temperature of the polishing pad and the detected temperature of the polishing pad.

43. The polishing method according to claim 38, wherein said ejecting of the gas toward the polishing pad is conducted while adjusting a height of said plurality of gas ejection nozzles.

* * * * *